US008712780B2

(12) United States Patent
Narayanan

(10) Patent No.: US 8,712,780 B2
(45) Date of Patent: Apr. 29, 2014

(54) SYSTEMS AND METHODS FOR PICTURE BASED COMMUNICATION

(75) Inventor: Ajit Narayanan, Los Altos, CA (US)

(73) Assignee: Invention Labs Engineering Products Pvt. Ltd., Chennai (IN)

( * ) Notice: Subject to any disclaimer, the term of this patent is extended or adjusted under 35 U.S.C. 154(b) by 128 days.

(21) Appl. No.: 13/314,206

(22) Filed: Dec. 8, 2011

(65) Prior Publication Data

US 2012/0330669 A1 Dec. 27, 2012

(30) Foreign Application Priority Data

Dec. 8, 2010 (IN) ..... 3746/CHE/2010

(51) Int. Cl.
*G10L 21/06* (2013.01)

(52) U.S. Cl.
CPC ..... *G10L 21/06* (2013.01)
USPC ..... 704/271

(58) Field of Classification Search
CPC ..... G10L 21/06
USPC ..... 704/270, 271
See application file for complete search history.

(56) References Cited

U.S. PATENT DOCUMENTS 5,748,850 A * 5/1998 Sakurai ..... 706/50
6,115,482 A * 9/2000 Sears et al. ..... 382/114

* cited by examiner

*Primary Examiner* — Susan McFadden

(57) ABSTRACT

A picture based communication system and mechanisms of implementation thereof allowing for rapid translation of picture based input into words or sentences of a previously chosen output language. Communication systems may be incorporated on PCs, mobile devices or may be a software running on a remote system which allows for language-independent messages to be constructed, which can be de-constructed into any language on the receiver's side. Mechanisms of implementation would also be of assistance in allowing people with language difficulties, dyslexia or illiteracy to communicate effectively.

34 Claims, 30 Drawing Sheets

FIG. 1
| | |
|---|---|
| 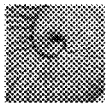 | A long flexible snout of an elephant |
| 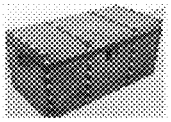 | Luggage consisting of a large strong case |
| 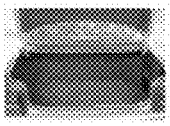 | Compartment in an automobile that carries luggage or shopping or tools |
| 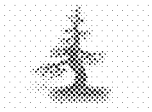 | The main stem of a tree; usually covered with bark |
| 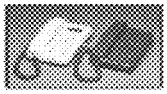 | A telephone line connecting two exchanges directly |

FIG. 2

| DW ID | Word | Meaning | Image |
|---|---|---|---|
| 15128 | Trunk | A long flexible snout of an elephant | |
| 9161 | Trunk | Luggage consisting of a large strong case | |
| 9873116 | Trunk | Compartment in an automobile that carries luggage or shopping or tools | |
| 98017 | Trunk | The main stem of a tree; usually covered with bark | |
| 38571 | Trunk | A telephone line connecting two exchanges directly | |

| DW ID | Word |
|---|---|
| 15128 | Trunk; proboscis |
| 9161 | Trunk |
| 9873116 | Trunk; luggage compartment |
| 98017 | Trunk; tree trunk; bole |
| 38571 | Trunk |

FIG. 3

WordNet Search for "trunk":

Noun

- {13165815} S: (n) trunk, tree trunk, bole (the main stem of a tree; usually covered with bark; the bole is usually the part that is commercially useful for lumber)
- {04491769} S: (n) trunk (luggage consisting of a large strong case used when traveling or for storage)
- {05549830} S: (n) torso, trunk, body (the body excluding the head and neck and limbs) "*they moved their arms and legs and bodies*"
- {03696065} S: (n) luggage compartment, automobile trunk, trunk (compartment in an automobile that carries luggage or shopping or tools) "he put his golf bag in the trunk "
- {02452967} S: (n) proboscis, trunk (a long flexible snout as of an elephant)

| DW ID | Word | Meaning | Image |
|---|---|---|---|
| 02452967 | Trunk | A long flexible snout of an elephant | 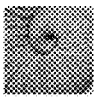 |
| 04491769 | Trunk | Luggage consisting of a large strong case | 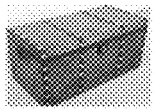 |
| 03696065 | Trunk | Compartment in an automobile that carries luggage or shopping or tools | 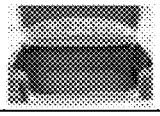 |
| 13165815 | Trunk | The main stem of a tree; usually covered with bark | 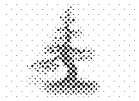 |

| DW ID | Part of Speech | Number | Animate/ Inanimate? | Category |
|---|---|---|---|---|
| 02452967 | Noun | Singular | Animate | Animal |
| 04491769 | Noun | Singular | Inanimate | Artificial Thing |
| 03696065 | Noun | Singular | Inanimate | Artificial Thing |
| 13165815 | Noun | Singular | Inanimate | Plant |

FIG. 4A

| DW ID | English Word | Plural Form |
|---|---|---|
| 02452967 | Trunk | Rule 1 |
| 04491769 | Trunk | Rule 1 |
| 03696065 | Trunk | Rule 1 |
| 13165815 | Trunk | Rule 1 |

| Plural Rule# | Description |
|---|---|
| 02452967 | Add –s |
| 04491769 | Add –es |
| 03696065 | Remove –ex and add –ices |
| 13165815 | Remove –fe and add –ves |

FIG. 4B

| DW ID | English Word | Plural Form | Adverb Rule |
|---|---|---|---|
| 02452967 | Noun | Singular | Animate |
| 04491769 | Noun | Singular | Inanimate |
| 03696065 | Noun | Singular | Inanimate |
| 13165815 | Noun | Singular | Inanimate |

FIG. 4C

FIG. 5

| DW ID | Meaning and Sample Sentence | Image | English | Spanish | Italian |
|---|---|---|---|---|---|
| 03696065 | Compartment in an automobile that carries luggage or shopping or tools; "he put his golf bag in the trunk" | | Trunk | Maletero | bagagliaio |

"we set forth a few obstacles encountered by handicapped individuals while using current electronic devices."

"he told the carpenter he could not pay him."

Sentence: "he told the carpenter he could not pay him.."

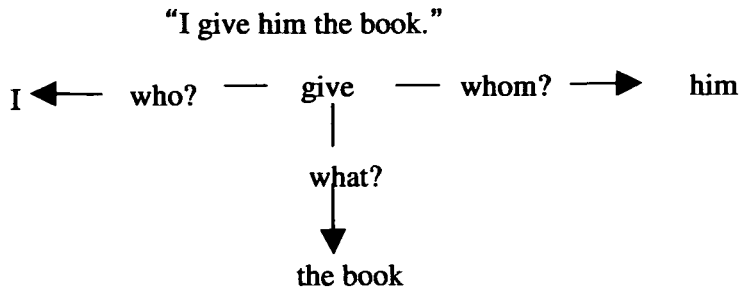
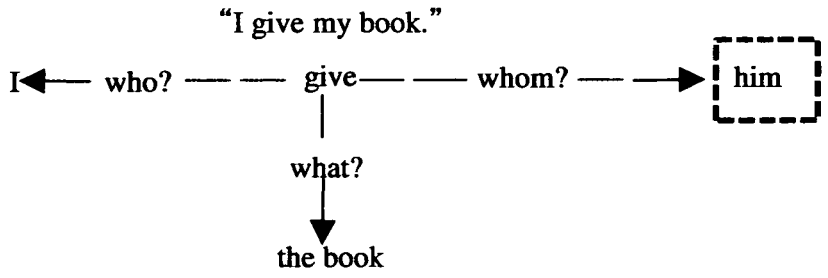
Fig.13

| Question | Example | Answer | Meaning |
|---|---|---|---|
| who? | Eat | I | I eat |
| For whom? | Take | he | Take for him |
| with whom? | Eat | father | Eat with father |
| with whom? | Compete | I | compete with me |
| what? | Eat | food | Eat food |
| whom? | See | she | See her |
| to whom? | Give | them | Give to them |
| what is? | red | leaf | Leaf is red. |
| Using what? | Write | pen | Write using pen |
| A part of what? | cover | book | cover is a part of book |
| Named what? | son | ABC | son named ABC |
| About what? | book | China | book about China |
| What kind? | book | red | red book |
| Whose? | book | I | my book |
| How many? | book | three | 3 books |
| From where? | book | the library | book from the library |
| To whom? | letter | you | letter to you |
| Why? | come | you | come because of you |
| Where? | Eat | home | eat at home |
| Where from? | Go | here | Go from here |
| Where to? | Go | there | Go there |
| Where through? | Go | here | Go via here |
| Where in? | See | TV | See on TV |
| When? | eat | noon | Eat in the morning |
| From when? | Sleep | 10 o'clock | sleep from 10 o'clock |
| Till when? | Sleep | 8 o'clock | sleep till 8 o'clck |
| During what? | Sleep | class | Sleep during class |
| While what? | Read | eat | Read while eating |
| After what? | Read | eat | Read after eating |
| How? | Run | fast | Run fast |
| On what condition? | Sleep | tired | Sleep if tired |
| By what method? | come | drive | come driving |
| For what purpose? | came | eat | came to eat |
| From what? | change | red | change from red (to green) |
| To what? | change | green | change (from red) to green |
| On what basis? | more | me | more than me |
| In what proportion? | eight | kilo | eight per kilo |

FIG. 15

| DW ID | RELATION | CAT OF ANSWER | FREQUENCY |
|---|---|---|---|
| walk | Who? | person | 50 |
| walk | Who? | animal | 15 |
| walk | Where to? | place | 98 |
| walk | Where to? | abstract | 4 |
| walk | Where from? | place | 40 |
| walk | In what manner? | speed | 4 |
| walk | In what manner? | attribute | 5 |
| walk | In what manner? | perception | 1 |

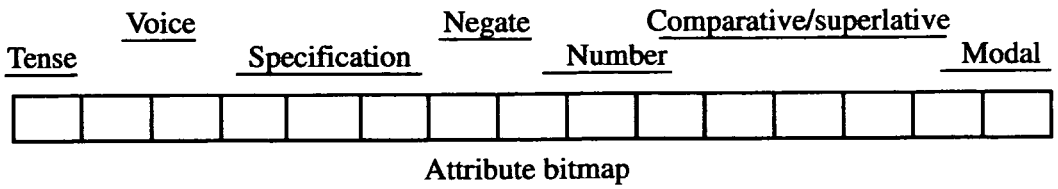

| Category | Descriptor | Example | Result |
|---|---|---|---|
| Tense | past | go | went |
| | present | go | goes |
| | future | go | will go |
| | perfect | go | had gone |
| | continuous | go | going |
| Voice | active | I ate | I ate |
| | passive | I ate | Eaten by me |
| Specification | def (definite) | apple | the apple |
| | indef (indefinite) | apple | an apple |
| | both (both) | apple | both apples |
| | distal (far from the speaker) | apple | that apple |
| | proximal (near the speaker) | apple | this apple |
| | certain (certain) | apple | a certain apple |
| Negation | no (none) | eat | not eat |
| Number | any (any) | cow | any cow |
| | all (all) | cow | all cows |
| | every (every) | cow | every cow |
| | singular (default) | cow | cow |
| | pl (plural) | cow | cows |
| Comparative | more | big | bigger |
| | less | big | less big |
| | equal | big | as big as |
| Superlative | most | big | biggest |
| | least | big | least big |
| Modality | ability | sit | can sit |
| | command | sit | Sit! |
| | intention | sit | want to sit |
| | necessity | sit | need to sit |
| | permission | sit | may sit |
| | request | sit | please sit |

FIG. 17

FIG. 18
"I give him the book"
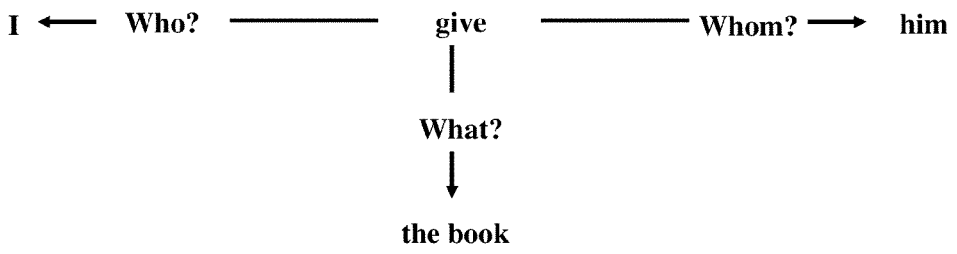
"who gives him the book?"
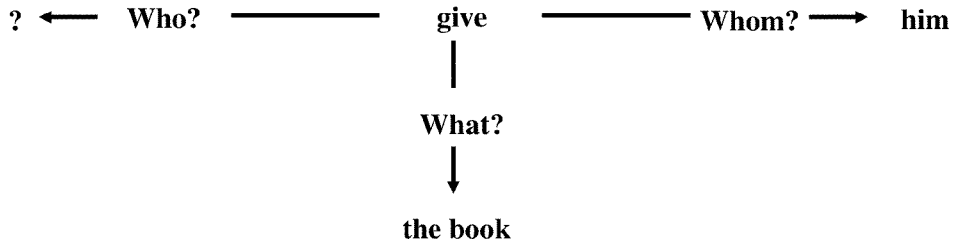
"whom do I give the book to?"
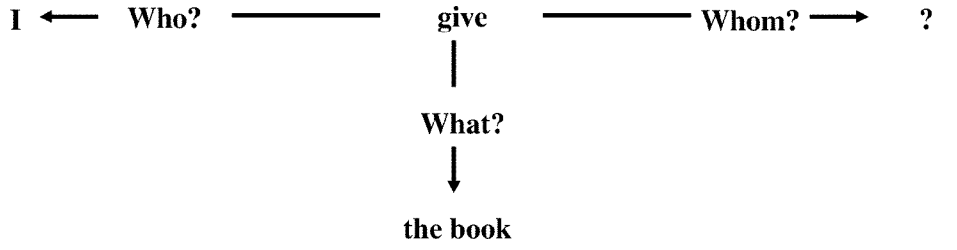
"What do I give him?"
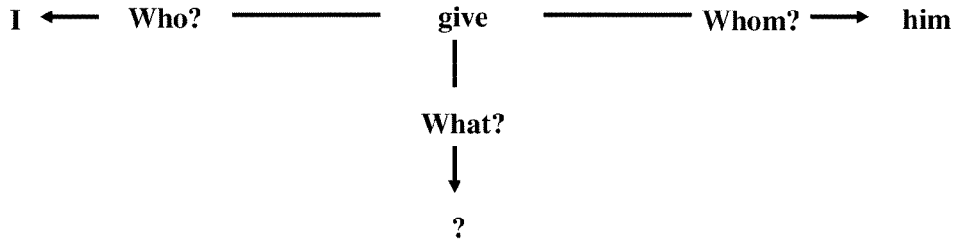

| Question | UNL relation |
|---|---|
| who? | agt |
| For whom? | ben |
| with whom? | cag |
| what? | obj |
| whom? | obj |
| to whom? | gol |
| what is? | aoj |
| with whom? | ptn |
| Using what? | ins |
| with what? | cob |
| Kind of what? | icl |
| An instance of what? | iof |
| A part of what? | pof |
| Named what? | nam |
| Is what? | aoj |
| About what? | cnt |
| Is what? | equ |
| What kind? | mod |
| Whose? | pos |
| How many? | qua |
| From where? | frm |
| To whom? | to |
| And what? | and |
| Or what? | or |
| Why? | rsn |
| Where? | plc |
| Where from? | plf |
| Where to? | plt |
| Where through? | via |
| Where in? | scn |
| When? | tim |
| From when? | tmf |
| Till when? | tmt |

| Question | UNL relation |
|---|---|
| During what? | dur |
| While what? | coo |
| After what? | seq |
| How? | man |
| On what condition? | con |
| By what method? | met |
| For what purpose? | pur |
| From what? | src |
| To what? | gol |
| On what basis? | bas |
| In what proportion? | per |

Fig.20

| Descriptor | UNL attribute |
|---|---|
| past | @past |
| present | @present |
| future | @future |
| perfect | @perfect |
| continuous | @continuous |
| active | @active |
| passive | @passive |
| def (definite) | @def |
| indef (indefinite) | @indef |
| both (both) | @both |
| distal (far from the speaker) | @ distal |
| proximal (near the speaker) | @ proximal |
| certain (certain) | @certain |
| no (none) | @no |
| any (any) | @any |
| every (every) | @every |
| singular (default) | @singular |
| pl (plural) | @pl |
| more | @more |
| less | @less |
| equal | @equal |
| most | @most |
| least | @least |
| ability | @ability |
| command | @command |
| intention | @intention |
| necessity | @necessity |
| permission | @permission |
| request | @request |

Fig.21

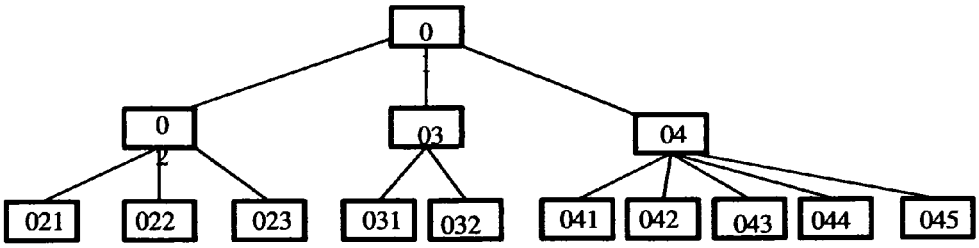
| | Question | Answer | Frequency |
|---|---|---|---|
| 041 | who ? | 02 | 5 (high) |
| 041 | who ? | 03 | 3 (medium) |
| 041 | who ? | others | 1 (low) |
| 042 | who ? | 02 | 1 (medium) |
| 042 | who ? | 03 | 1 (medium) |
| 042 | Who? | 04 | 1 (medium) |
| ... .... | Wbo? | ..... | ..... |
Save Space
| | Question | Answer | Frequency |
|---|---|---|---|
| 04 | who ? | 02 | 16 |
| 04 | who ? | 03 | 12 |
| 04 | who ? | others | 3 |
| 04 | who ? | 04 | 1 |
List of word with high frequency (02/who?)
| Answer | Frequency |
|---|---|
| w1 | 351 |
| w2 | 31 |
| w3 | 15 |
| w4 | 9 |
List of word with high frequency (03/who?)
| Answer | Frequency |
|---|---|
| w5 | 98 |
| w3 | 77 |
| w6 | 13 |
| w7 | 12 |
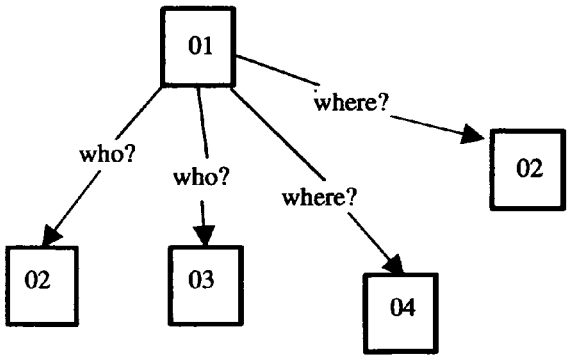
FIG. 27

SYSTEMS AND METHODS FOR PICTURE BASED COMMUNICATION

This application claims the benefit of Indian Provisional Application No. 3746/CHE/2010, filed Dec. 8, 2010.

TECHNICAL FIELD

This invention relates to communication techniques, and more particularly to a picture based communication system and related methods.

BACKGROUND

A number of different systems exist for the use of people with motor disabilities and verbal disabilities to communicate. An important category of these system are those that allow users to specify a word, phrase, sentence or passage that he or she wishes to say.

Some of the systems that exist today rely on alphabetical representations of words (and therefore, sentences) in order to create sentences. This process is often assisted by word prediction, the use of abbreviations, and the ability to store templates. Nonetheless, many of these systems are slow, language specific, and rely on the ability of a user to understand spelling and grammar.

Other systems are pictorial, and they possess the virtue of being easier to learn and use, and also to establish some degree of language flexibility. Pictorial communication systems are, therefore, popular and widely used amongst the non-verbal community to construct sentences to be spoken out.

There are two approaches to sentence construction with pictures that are in vogue today. The first approach consists of a system where every word in a sentence is stored as a picture, and a sentence is represented by such pictures shown next to one another. Examples of this form of sentence construction are the Board maker software, and the Dynavox system, both developed by Dynavox Mayer-Johnson of Pittsburgh, Pa. Primarily, this system allows the user to map a sentence directly into pictures word-for-word, and therefore, requires nothing more of a user's cognition than the ability to form sentences. In order to store a large vocabulary, however, the system must support a very large number of pictures; for a typical vocabulary used by an adult, it is estimated that more than 3000 words (and hence pictures) are required. This introduces the challenge of categorization, since it is impossible to show all 3000 pictures on a single screen. The user must then be trained to identify the categories and use them appropriately. Likewise, there are several words in most languages that defy categorization and which do not have images associated with them; for example, the words 'to', 'the' and 'extra' would be hard to express as pictures, or fit into a hierarchy of categories. Despite these challenges, the system of single-meaning pictures has been used quite effectively in a number of different applications, mainly by providing the ability to customize categories, classes and templates.

A very different approach to sentence construction with pictures was undertaken by Bruce Baker, who developed the principle of 'semantic compaction' through the use of a technology called Minspeak. Minspeak relies on the polysemy of a small set of pictures, which can be used to represent a large set of words. For instance, the picture of an apple may represent (in different contexts) the words 'apple', 'fruit', 'red', 'eat', 'hungry', 'gravity' or 'computer'. The system of Minspeak uses a small set of such images, which may be combined with other images to uniquely specify words, which are strung together to form sentences. For example, Minspeak allows a system with 144 pictures to represent more than a thousand words, and is claimed by its creator to be sufficient to hold complex conversations. The biggest drawback of Minspeak is the cognitive complexity of the system, which requires users to memorize a large number of combinations of pictures and the words they represent. Minspeak also requires the interlocutor of the user to be familiar with the system, though it is possible to use a microprocessor based system to convert Minspeak icon combinations into words in a language. The complexity of Minspeak is nearly that of a separate language in itself, which has to be taught and learnt in order to be used; therefore, it is not possible for a person with limited cognitive function (such as a mentally retarded child) to use Minspeak effectively.

BRIEF DESCRIPTION OF FIGURES

This invention is illustrated in the accompanying drawings, through out which like reference letters indicate corresponding parts in the various figures. The embodiments herein will be better understood from the following description with reference to the drawings, in which:

FIG. 1 is a pictorial representation of different meanings of the word 'trunk', according to embodiments as disclosed herein;

FIG. 2 illustrates a DW dictionary entry, according to embodiments as disclosed herein;

FIG. 3 illustrates a DW dictionary entry with wordnet IDs, according to embodiments as disclosed herein;

FIGS. 4A, 4B, 4C depict a DW Dictionary; a DW-to-English dictionary and a DW to English Dictionary, according to embodiments as disclosed herein;

FIG. 5 illustrates a DW dictionary with corresponding translations, according to embodiments as disclosed herein;

FIG. 13 depicts sentences along with appropriate descriptors, according to embodiments as disclosed herein;

FIG. 15 shows typical questions and answers, according to embodiments as disclosed herein;

FIG. 17 depicts an attribute bitmap, according to embodiments as disclosed herein;

FIG. 18 depicts a modified sentence, according to embodiments as disclosed herein;

FIG. 20 depicts question-answers and relations in UNL, according to embodiments as disclosed herein;

FIG. 21 depicts a representative sample of attributes and their corresponding descriptors, according to embodiments as disclosed herein;

FIG. 27 depicts an exemplary use of a tree of templates, according to embodiments as disclosed herein;

DESCRIPTION OF EMBODIMENTS

Figure 6:
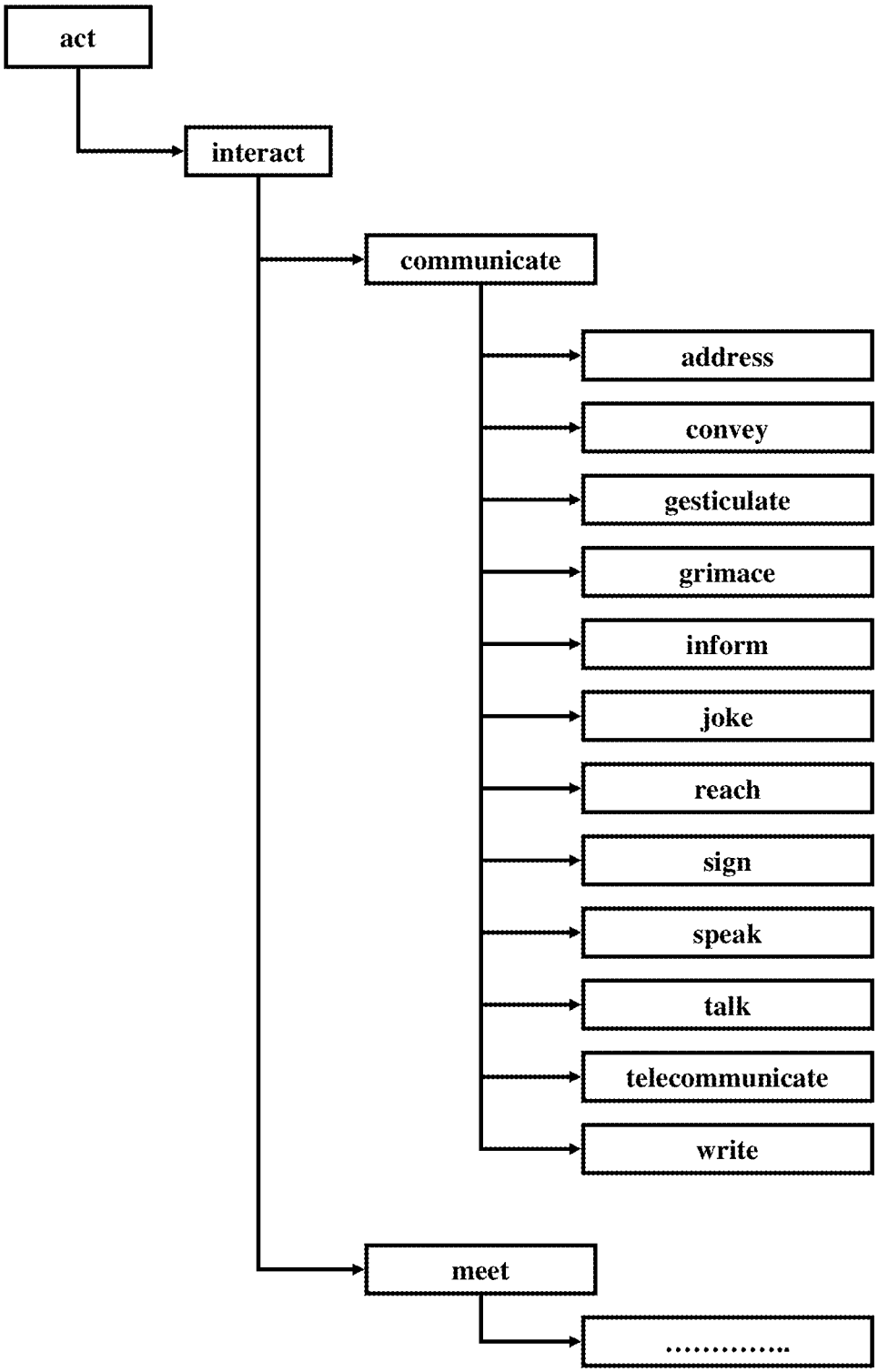
FIG. 6 illustrates a hierarchically arranged DW dictionary, according to embodiments as disclosed herein.

The embodiments herein and the various features and advantageous details thereof are explained more fully with reference to the non-limiting embodiments that are illustrated in the accompanying drawings and detailed in the following description. Descriptions of well-known components and processing techniques are omitted so as to not unnecessarily obscure the embodiments herein. The examples used herein are intended merely to facilitate an understanding of ways in which the embodiments herein may be practiced and to further enable those of skill in the art to practice the embodiments herein. Accordingly, the examples should not be construed as limiting the scope of the embodiments herein.

DEFINITIONS

Disambiguated Word (DW) Hypergraph: DW hypergraph is a hypergraph with nodes as individual DWs, or graphs of DWs as nodes, where the relationship between any two nodes is defined by a question and answer set. Further, each node may be associated with a plurality of descriptors.

Embodiments herein disclose the use of Disambiguated Word (DW) data structure for representing a unit of information. Embodiments herein pre-suppose the use of a picture to represent meaning at the level of a word or a phrase, as opposed to a sentence or a longer unit of meaning. There are two main challenges in achieving such a representation between a picture and smaller unit of information. First, a single word, in any language, may have more than one meaning. For example, take the word 'trunk' in English. This word may represent a part of an elephant, a part of a tree, a part of the body, a piece of furniture, or a part of a car. Obviously, each of these meanings of the word 'trunk' would require a different picture, as shown in FIG. 1.

On the other hand, many multi-word expressions have very different meanings when they are taken as a whole. The word 'square root' is an example in the English language. If an image is to be associated with this word, it is likely that the image is likely to have absolutely no relation to either of the words 'square' or 'root'. Thus, the commonly understood meaning of the term 'word' is both too big and too small to represent the unit of meaning that we are trying to capture using pictures. In order to address this constraint, use of a concept called the Disambiguated Word (DW) is proposed for the purpose of assigning images to represent words uniquely. Thus, the word 'trunk' has 5 Disambiguated Words associated with it, one for each of the meanings listed above. Similarly, the term 'square root' is listed as a separate word to be assigned an image, quite different from the words 'square' and 'root', which independently correspond to one or more disambiguated words.

DW Dictionary

Embodiments herein use a dictionary of disambiguated words as opposed to using a dictionary of words, thereby ensuring that each word can be unambiguously represented by an image.

The association of an image in the dictionary database present in the current invention is, therefore, at the DW level.

It is important to note that a DW is a unit of 'meaning' and not (normally) a unit of 'language'. Thus, purely syntactic words like 'to', 'the' and 'of' would not be represented as DWs, since these syntactic words may not exist in several languages, being instead represented through inflections, sentence order etc. Sometimes, there may be two or more words in a language that have exactly the same meaning, and which can be used interchangeably. In this case, the multiple words are canonically represented by a single DW, though (for the sake of completeness) a separate database may represent all words that are represented by a DW.

The process of building a DW dictionary is therefore, to take a list of words and phrases in a particular language, and for each word, enumerate the disambiguated meanings. A particular meaning is selected in order to create an entry. Next, all words in the dictionary that are perfect synonyms of the meaning are eliminated from the dictionary, in order to preserve a single picture per 'meaning'. An entry is then made for the DW, and (if required) an entry is made in another dictionary for all the natural words that correspond to the DW.

Once a meaning has been selected for inclusion in the DW dictionary, it is given a unique number. It may be inferred that this number is now language-independent, representing a 'meaning' and not a 'word'. We call this number the DW ID of the meaning, and it is the primary key for the image database. This DW ID may be 'translated' into one or more words or multi-word expressions in any particular language, and these translations may be stored in multiple dictionaries specific to that particular language. We call these dictionaries DW-to-Language dictionaries; e.g. DW-to-English. An image is then selected for the particular meaning. This process is repeated for all entries in the dictionary, and a DW dictionary is thus created. The resulting tables are shown in FIG. 2.

Embodiments herein achieve creation of DW database and association of DW identifiers with meanings by selecting DW IDs in such a way as to reuse vast bodies of work that already exist in literature. The best way to do this is to reference a DW to a particular lexical database. A lexical database is a database that stores disambiguated meanings of words and multi-word expressions, along with a number of other pieces of information about the words (e.g. their hypernyms, hyponyms, categories, etc.) An example of one such lexical database is "WordNet".

Lexical databases associate each meaning of each word to a unique location. Embodiments herein use such unique identifiers (such as the unique location of the word in WordNet) as a DW ID. WordNet results for the word "trunk" are shown in FIG. 3. WordNet Ids are incorporated into the dictionary of FIG. 2, and shown in FIG. 3.

The DW dictionary which stores the DW id, its part of speech, and other grammatical information such as its valency, transitivity etc.; and dictionaries representing DW-to-English, DW-to-Spanish, DW-to-Italian, DW-to-Hindi, DW-to-Mandarin and other transformations. The latter dictionaries also contain the grammatical information required to use the DW's representation in the respective language with the appropriate morphology (for example, inflectional forms).

Embodiments herein employ a plurality of dictionaries that are used in conjunction with each other in order to enable a picture-based communication system.

One of the dictionaries is a dictionary listing various DWs. This dictionary, in its simplest form, contains nothing more than a list of numbers and corresponding images, with each number corresponding to a DW. However, this list may also be annotated with a number of other pieces of information which are language-independent. For example, the list may contain, for each DW, its part of speech; its transitivity (if it is a verb); special number information (for example, if it is to be represented as Singular Tantum or Plural Tantum); its valency (i.e. the number of objects that it takes); and associative information among others. This dictionary can also contain information about Category, which will be discussed in a subsequent section. This dictionary is referred to as the "DW Dictionary" and is used as the primary repository for content. We call this dictionary the "DW Dictionary".

In various embodiments, the DW dictionary will be expanded, contracted, or masked to reveal the vocabulary that is appropriate to specific needs of specific groups group, when it is required to create a gradation of vocabularies for people of different ages, cognitive abilities, or belonging to specialized occupations to use.

In addition to the DW dictionary, the system includes at least one DW-to-Language dictionary. Although this is called a dictionary, it is a multi-valued hash, but for ease of explication, it will be referred to as a DW-to-Language Dictionary. The DW-to-Language dictionary can include list of DWs and their corresponding words in the particular language (e.g. English), the linguistic information that is needed to use the particular word to create sentences in the particular language. For example, the dictionary contains full 'morphological information', i.e. providing a system of denoting how to inflect the particular word, depending on the requirement of the language.

In various embodiments, the DW-to-language dictionary may also consist of particular usages depending on the framing of the word. For example, the words 'tomorrow', 'Sunday' and 'noon' are all words that describe time. In the DW dictionary, they all constitute unique entries. When used in a sentence, however, each of these words is to be used in a different manner. For example, consider each of these words as modifying a sentence "We are going to the park". The word 'tomorrow' modifies the sentence as "We are going to the park tomorrow"; 'Sunday' as "We are going to the park on Sunday"; and 'noon' as "We are going to the park at noon". In this case, the preposition (respectively none, "on" and "at") would be stored in the DW-to-English dictionary, since it is specific to English, and is necessary in order to correctly use the word in a sentence.

Similarly, in languages where nominal concepts have gender (such as French or Hindi), this gender information would be represented in the DW-to-language dictionary. The DW dictionary, and two DW-to-English dictionaries, is shown in FIGS. 4A, 4B and 4C.

Once a particular DW-to-language dictionary has been created, it is possible to use this as an effective tool for creating other DW-to-language dictionaries. This is done by back-referencing the word to its DW, and from the DW ID to its entry in a lexical database such as Wordnet. From the entry in the lexical database, a gloss may be extracted, which describes the word's meaning, sometimes with the use of sentences.

This gloss tremendously aids translation, as well as providing a manner for performing the translation in a distributed manner. Since this gloss (and the fact that the word has been disambiguated) means that the meaning of the word is very specific, the likelihood of finding a particular word which represents its meaning is high. Automatic dictionary lookup or translation engines can be used to automate the task of finding equivalent words or multi-word expressions in other languages. A very simple UI for this is shown in FIG. 5, with Spanish and Italian translations.

The entries in this UI are used to create entries in corresponding DW-to-Spanish and DW-to-Italian dictionaries; the DW dictionary itself is not changed.

Ontology

For a reasonable-sized vocabulary, the number of DWs in the dictionary may run into the thousands. Therefore, it is proposed to categorize the words in the form of ontology. Ontologies are categorizations of words for the purpose of natural language understanding and artificial intelligence inference.

The use of an ontology based on word sense allows for a broad categorization based on meaning. For instance, the words 'joke', 'speak' and 'gesticulate' all have very different spellings and positions in the dictionary. However, in every language, it is true that these words are forms of 'communication'. FIG. 6 illustrates arranging them in the hierarchy of their word sense. Such arrangement provides a language independent mechanism of finding a word by navigating categories of similarity.

The ontological information is encoded in our DW dictionary by including a field called "category". This category field has the DW ID of the category name. The category name is also a word in the DW Dictionary, being associated with a picture and with other mark-up information. When a word is used as a category, it has a separate DW entry; it does not reuse the same DW ID as the word whose spelling it shares.

Embodiments herein depict ontological categories pictorially, since ontological category names also find a place in the dictionary. The distinction between using these DWs as categories and as words (independently) is established by a styling gloss in the pictures. For example, a small plus ('+') symbol on the top right corner of an image may indicate that selecting it will open up a category instead of using the picture itself.

By arranging words in a natural ontology, and representing both the words as well as the categories by pictures, embodiments herein achieve creating a categorized nest of words, which can be navigated in a pictorial manner, and which can be extended to cover any broad vocabulary.

In various embodiments, multiple ontologies may be created and maintained by the system. Ontologies may be created for arranging like words together. Ontologies may also be created for providing customized ontologies to user based on their contexts. Ontologies may also be created for grammar purposes, as a means of establishing a hierarchy of rules instead of establishing rules for each word in the dictionary. Further, ontologies may also be created based on statistical usage of words rather similarity of words. Furthermore, ontologies may be created as 'canonical' ontologies. A canonical ontology is a standardized form on ontology available from databases like WordNet.

In various embodiments, ontologies may be derived from existing structures like those of hypernym and hyponym relationships from WordNet. In other embodiments, new ontologies may be created and used based on specific needs.

Just as creating a DW dictionary was almost prohibitively difficult to create without the right tools, so too is the process of arranging the DWs in an ontological hierarchy.

Figure 7:
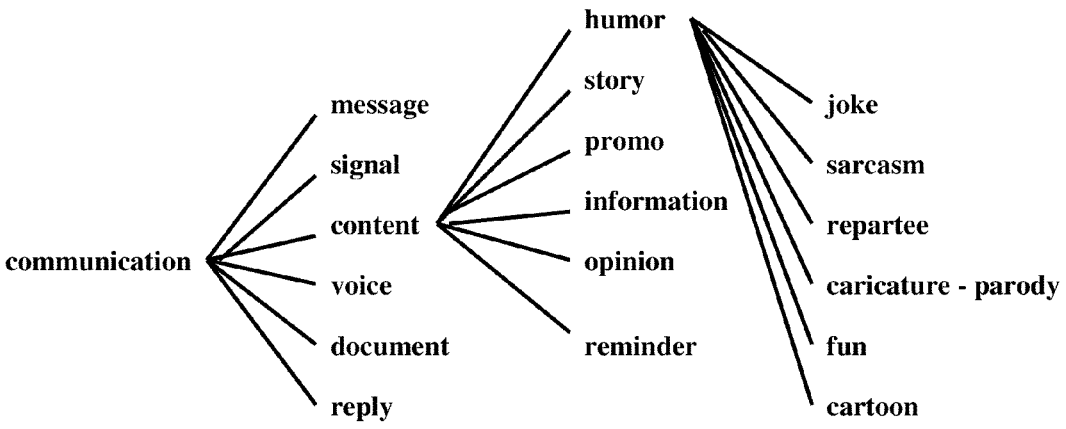
FIG. 7 illustrates an ontology, according to embodiments as disclosed herein.

The exercise of creating ontology for the English language has already been performed by a number of tools that are readily available online. For example, the ontology shown in FIG. 7 (which is very similar to the ontology in FIG. 6) depicts the ontology for the word 'parody'. This has been extracted from Word net's hypernym and hyponym relationships. (Word Net's hypernym/hyponym relationships currently exist only for nouns and verbs, but a number of other tools have arisen to extend this to adverbs and adjectives also).

The ontology created as per the above process yields an ontology that is particularly well suited for arranging like words together. However, it may also be necessary to use ontology for a few other purposes, which may necessitate maintaining multiple ontology's in the system.

For instance, the ontology used for displaying hierarchies on screen for the user to choose from may be different from the canonical WordNet ontology. This ontology of words may be customized by the user, perhaps by context instead of by meaning. For example, the user may wish to put various verbs, nouns, adjectives and adverbs related to schooling under the category 'school', for ease of memorizing and for ease of use. The word 'study', for example, may be an act of 'cognition' under a strict hierarchy, but may be a 'school' action under a user-customized hierarchy (for display purposes).

Ontology may also be created for grammar purposes, as a means of establishing a hierarchy of rules instead of establishing rules for each word in the dictionary. This is described in more detail herein.

Figure 8:
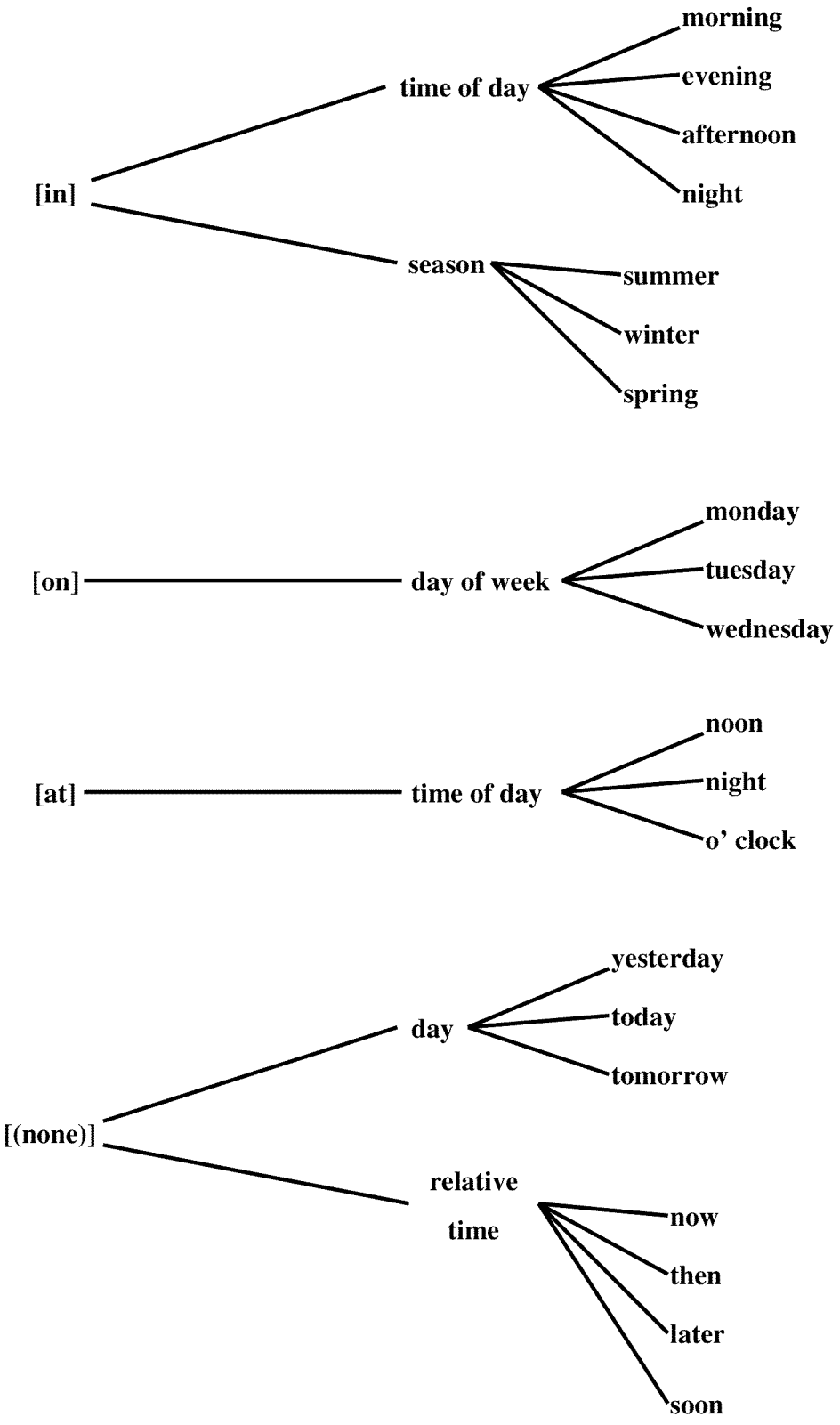
FIG. 8 illustrates a word classification by 'usage', according to embodiments as disclosed herein.

Within categories, words may also be classified by "usage". For example, under "time"-related words (adverbs), a finer classification may be on the basis of how to create adverbial adjuncts using the root word. FIG. 8 shows how a category, like time of day, may have two sub-categories, namely 'at' words and 'in the' words, depending on which of these two prefixes is used to create an adverbial phrase. ("In the morning" is syntactically correct, whereas "at noon" is correct.)

In addition, the words in a dictionary may also be ontologically arranged on the statistical features of their usage. For example, verbs whose object is typically from the class 'person/people' may form sub-ontology. (This ontology would significantly assist in predicting answers to various questions that are rooted at the particular verb).

Further, ontology may be created as a 'canonical' ontology, which is the standardized ontology that is available from, say, WordNet. This standard ontology may be pruned or customized based on the vocabulary of the individual and any custom memorization techniques. In addition, this ontology may be further modified to establish grammar rules, and likewise be further modified to accommodate statistical rules.

Like the canonical ontology, all of these ontology's are also represented in the appropriate dictionaries as category information. Storage of the ontology on a remote server accessed through the internet It is assumed so far that the ontology on which the entire system is based is stored locally in the device. This has a number of advantages; for example, it would be possible to use the system without necessitating connectivity, and it would possibly reduce power consumption (and thereby increase battery life).

Figure 9:
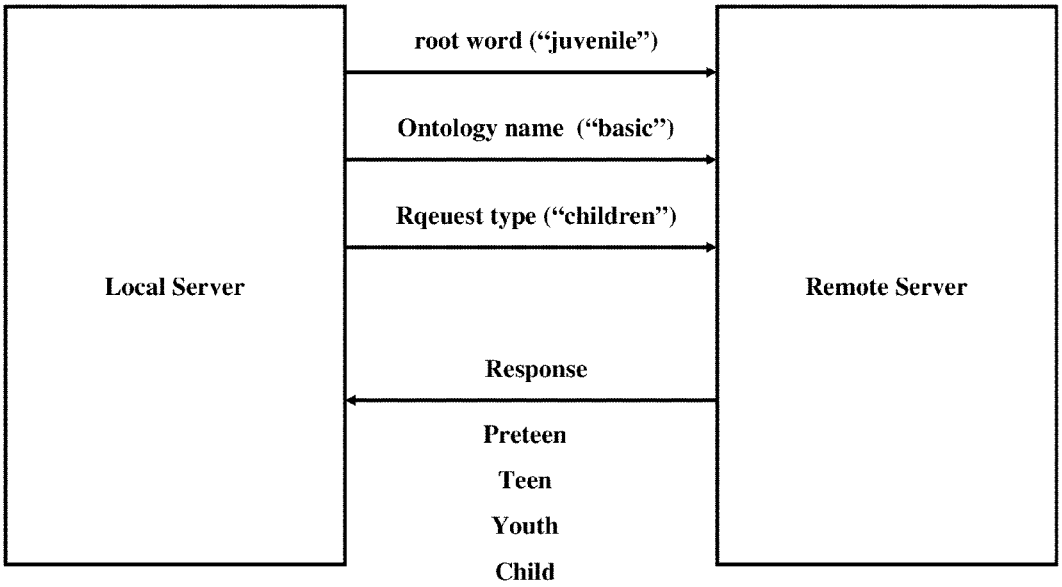
FIG. 9 depicts a networked system, according to embodiments as disclosed herein.

In various embodiments, the ontology or ontologies may be stored on a server that is remotely accessed by the device on an as-needed basis as depicted in FIG. 9. In such cases, the requests made to the remote server could include but are not limited to "parent", "children", "sibling", sibling of parent, and so on. This allows the ontology to be independently maintained, with words added to it on a global basis by skilled practitioners. This would allow all devices that are on the network to be constantly kept updated with the latest ontology.

In various embodiments, the system allows collection of statistics about the usage of individual DWs and categories, to assist in improving prediction and analysis on a global level as opposed to a user level.

In various embodiments entire set of dictionaries may be stored on a remote server and accessed on an as-needed basis by the software system residing locally on a user device.

Representation in Question Format

Embodiments herein achieve creation of complex sentences from DWs using a principle called "questioning".

Let us assume the following sentence: "We set forth a few of the obstacles encountered by handicapped individuals when using current electronic devices"

In this sentence, one can start with the DW "setting forth", and successively ask the following questions:

"set forth"
"who sets forth?"=we set forth.
"set forth what?"=set forth obstacles
"what obstacles?"=obstacles that are encountered
Who Encountered?=Individuals
What kind of individuals?=handicapped individuals
Encountered when?=when using . . .
Using what?=devices
What devices?=Electronic
What devices?=Current
"How many obstacles?"=a few obstacles In this way, the complete sentence can be fully specified. Using the above formulation, the sentence may eventually be rendered as "we set forth a few obstacles that handicapped individuals encounter when using current electronic devices". In doing so, there may be a deviation from the verbatim representation of the original sentence; however, there is no deviation from the meaning of the original sentence.

All sentences, however complex, can be decomposed as a cascading set of answers to a set of questions. This generates a data structure that looks like a tree; however, it is not strictly a tree, since the data structure may contain back-references and inter-links. (For example, the sentence "he told the carpenter that he could not pay him", has internal references for two pairs of pronouns. If represented as a strict tree, the internal references cannot be represented.)

Figure 10A:
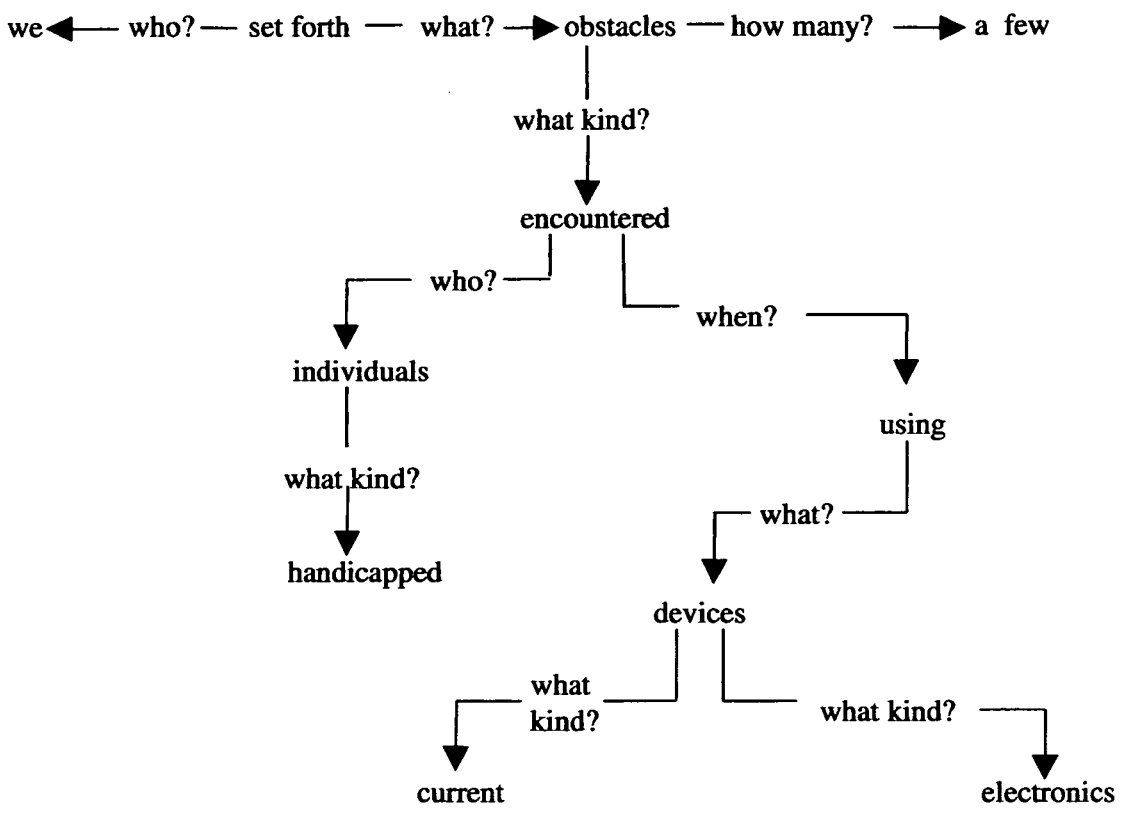
FIGS. 10A and 10B illustrate the meaning of sentences, according to embodiments as disclosed herein.
Figure 10B:
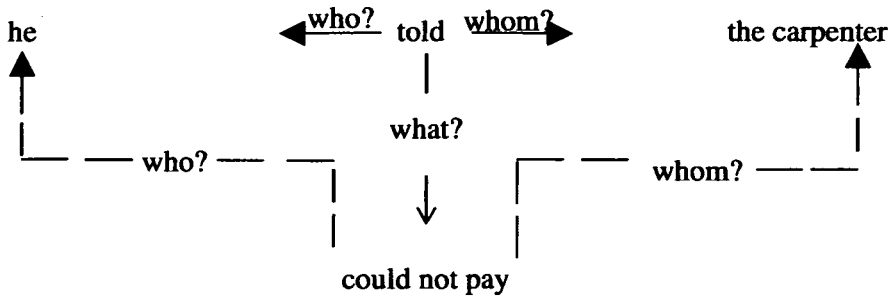

Using the mechanism of questioning, a "network" that represents the meaning of a sentence, through the use of DWs is arrived at. In the aforementioned example, the DWs are "set forth", "we", "obstacles", "encountered", "handicapped", "individuals", "devices", "electronic" and "current". This is shown in FIG. 10A. In the latter example, the DWs are "he", "told", "carpenter" and "could not pay". This is shown in FIG. 10B.

The DWs, though present in the DW dictionary, may not be present in the same form as we have represented above. For example, "obstacle" may be present in the DW dictionary; "obstacles" may not. This is intended, since they represent the same meaning, except that one is an inflectional form (plural) of the other. Similarly, "encountered" is inflected from "encounter", and so on.

To avoid modifying either the questions or the actual DWs, a descriptor for each DW is introduced. The descriptor specifies various tense, aspect, gender and number information.

Figure 11A:
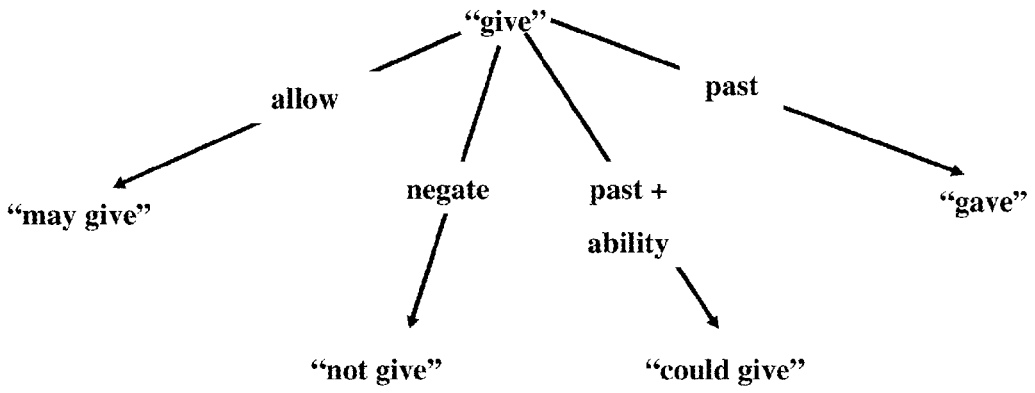
FIGS. 11A and 11B illustrate descriptors for verbs and nouns respectively, according to embodiments as disclosed herein.
Figure 11B:
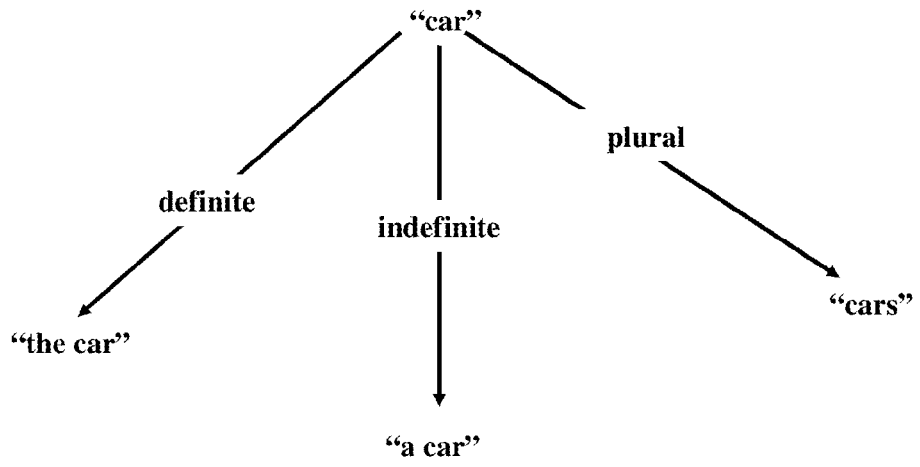

Some example descriptors for verbs and nouns are shown in FIGS. 11A and 11B respectively.

Figure 12:
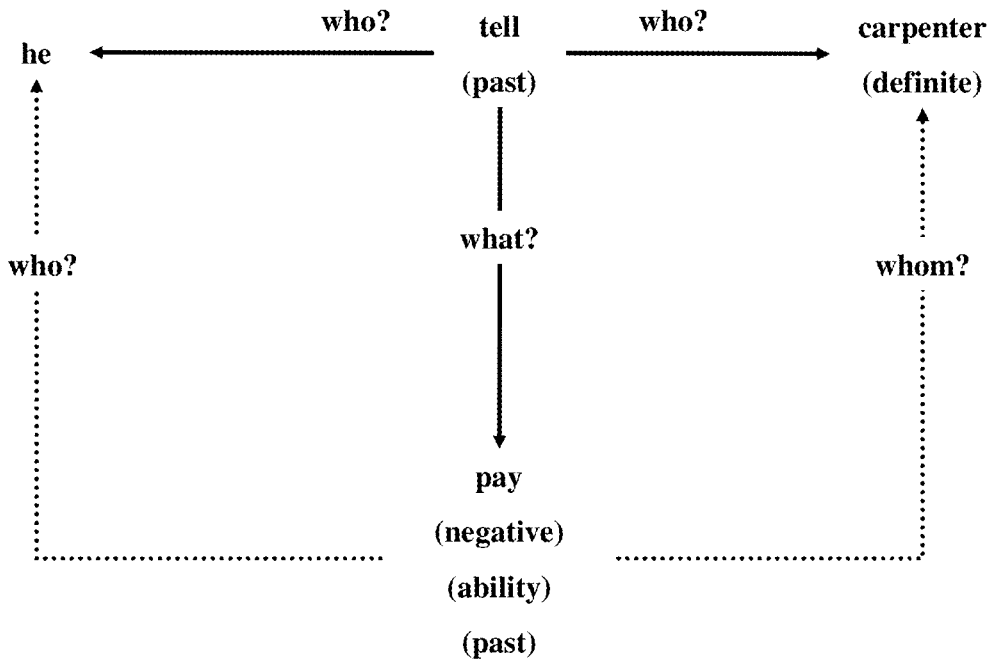
FIG. 12 depicts a sentence along with appropriate descriptors, according to embodiments as disclosed herein.

Therefore, embodiments herein represent the meaning of an entire sentence using DWs, modified by their descriptors, and combined by question-answers. The example of FIG. 10B, with appropriate descriptors, is shown in FIG. 12.

This system of representation of a sentence using DWs, descriptors, and question-answers, is language-independent. Further, the association of a DW with a certain set of questions that can be asked about is also language independent.

For example, the DW representing the word 'give' would, in most languages, have three basic questions that will have to be answered for the word to be fully used in a sentence. The three questions are: "who gives?", "gives to whom?", and "gives what?". These questions are dependent on the transitivity of the verb. If the answer to one of these questions is not specified, it nonetheless exists; only, it is to be referred to elliptically.

In addition, a number of 'optional' questions may be asked: "gives in what manner?", "gives where?" and "gives when?" are examples. These questions are adverbal in nature, and may be theoretically asked of any verbal DW.

Figure 14:
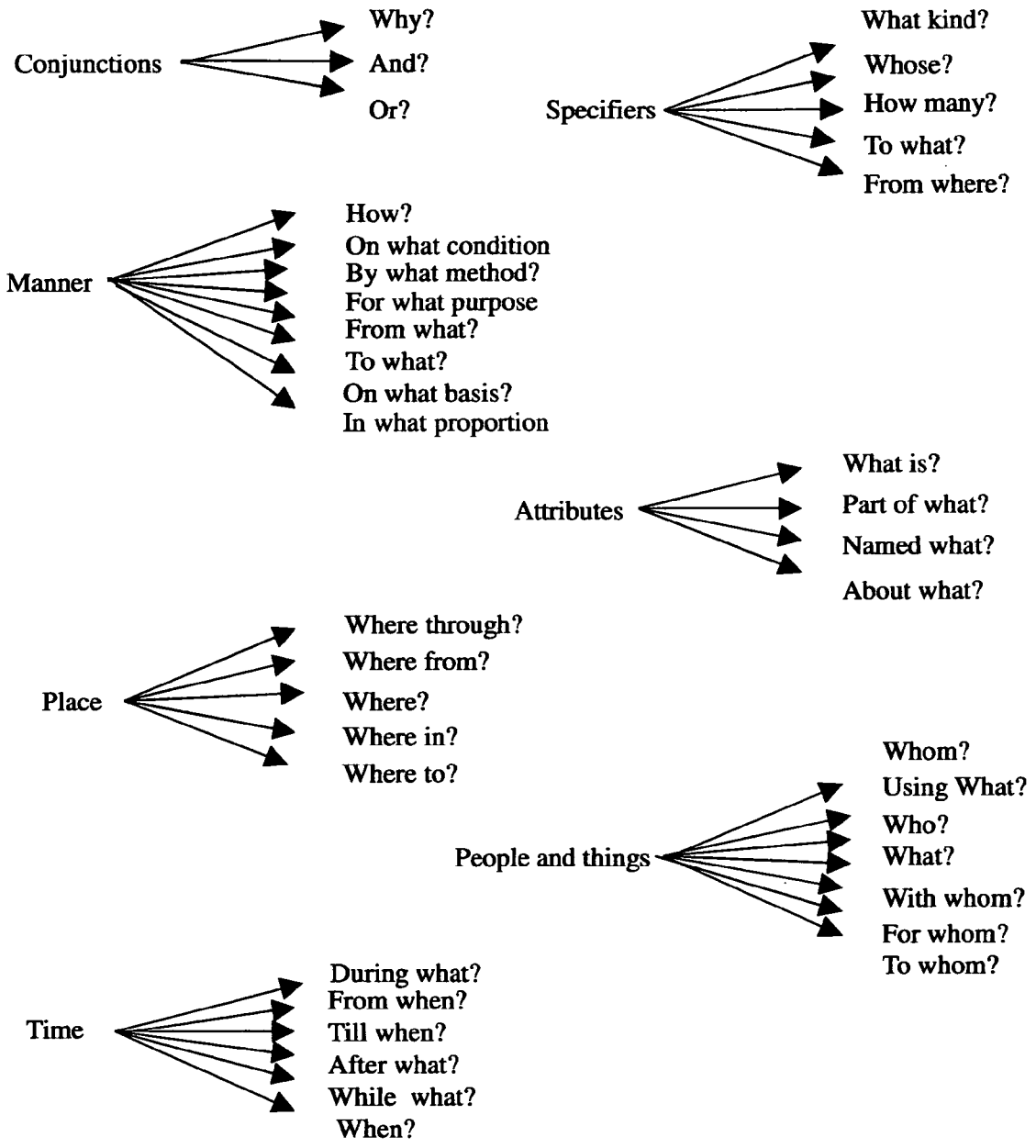
FIG. 14 depicts a candidate list, according to embodiments as disclosed herein.

FIG. 14 shows a candidate list, and FIG. 15 shows typical questions and answers. The list of descriptors, still finite, is somewhat larger. A candidate list of descriptors is shown in FIG. 17.

The descriptors, unlike the questions, may not have a realization in every language (that is to say, there may be descriptors that have an impact on the sentence only in some languages). For example, one descriptor may be the descriptor for "politeness" or "formalness". This may theoretically transform a sentence in such a way as to represent that it is being spoken to a social senior. This descriptor is, however, only applicable in some languages (e.g. Japanese and Hindi) where the word's inflection changes depending on the social target, whereas in languages such as English, there is no specific mechanism to express "politeness" other than by the choice of a different set of DWs. Similarly, the descriptors for the "inclusive" and the "exclusive" forms of the word "we" are present in some languages, but not in English. The complete set of descriptors can, therefore, be regarded as a 'superset', from which a certain subset may be applicable to a particular language.

Annotating the Database

The questions that are associated with a word are related to its part-of-speech, transitivity etc. and can be statistically specified; in addition, the answers to the questions also follow certain statistical distributions when combined with the ontology.

For example, the DW 'walk' (a verb) would have two associated questions: "who walks?" and "walks to where?". This is derived, in a large part, from the ontology of the word. The first question is a result of the transitivity of the verb 'walk', and the second is because of the category that the word 'walk' falls under.

Also, the categories of the answers to the questions fall in pre-determined sets. For example, the question "who walks?" is most likely to be answered with a DW that would fall in the category "Persons", while the question "walks to where?" would be answered with a DW that would fall in the category "Places". If it is possible to obtain a statistical ordering of questions and categories of answers for each DW, we would be able to prompt a user to select the answer quickly by showing the most likely categories instead of showing all possible categories as possible answers for all DWs and all questions.

Figure 16:
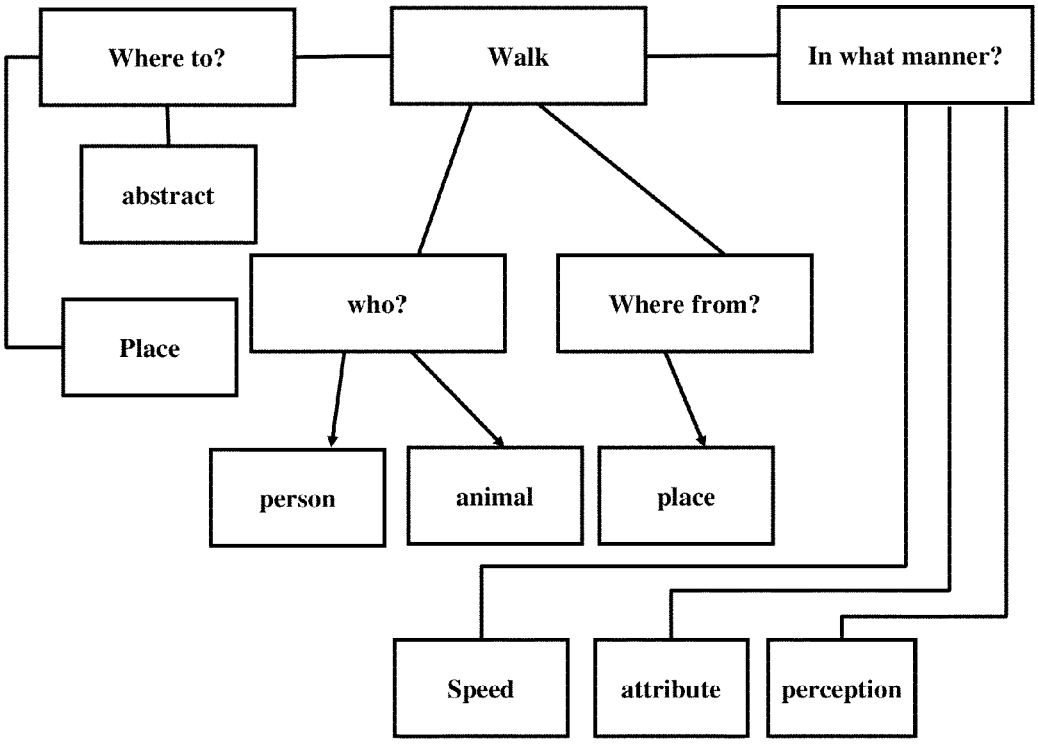
FIG. 16 depicts a list of descriptors, according to embodiments as disclosed herein.

Such a statistical database could be built by trawling through a large corpus of sentences, preferably chosen from an area of discourse that coincides with the target discourse (for example, if the user is creating sentences for the purpose of spoken conversation, the corpus of sentences should preferably be a corpus of spoken sentences). This corpus is to be expressed in the form of DWs, questions and answers. Such a statistical database is shown in FIG. 16, for the word 'walk'.

The problem is that most corpora used in natural language processing are, in fact, expressed in natural language. So these corpora may not be usable directly for us to infer questions and answers. One level of processing which may have been performed with these corpora is that the words may have been disambiguated through a lexical database such as WordNet. However, the process of expressing sentences in the required form (as a network of DWs, descriptors and questions) would still need to be done. In the absence of a computational or mechanical way of doing this, we anticipate a human-assisted exercise of converting large corpora into sentence graphs according to our description.

In various embodiments, a database that shows, for each DW, the possible questions that may be asked of it, and the categories in which possible answers is used. Such a database may be derived from aforementioned corpus. When a DW is selected, the relative probabilities of different questions to be asked of it are calculated, and once a question has been selected, for the particular DW, relative probabilities of different answers for it are calculated.

Descriptors of a DW

As with questions, it is also possible to create statistical tables of descriptors. In this case, however, there is a further step which can be performed. While we cannot limit the categories of answers without limiting the ability to express some thoughts, we can definitively say that some combinations are impossible—for example, a verb cannot be in both present and past tense at the same time, and a noun cannot (in English) have tense information associated with it. After eliminating such categories, a table of the applicability of multiple different descriptors is created for a particular word based on its part-of-speech. This is shown as an attribute bitmap in FIG. 17. The table lists 6 different 'modal' forms; since only one of these may be active at any time, the last three bits of the attribute bitmap represent the modal that is chosen.

When a particular DW is selected, the appropriate descriptors are shown. As one or more of the descriptors are selected, the list changes to reflect the now appropriate ones amongst the remaining descriptors.

Construction of Interrogative Sentences

Interrogative sentences may be split into two forms. One form answers a particular question, such as 'what', 'when', 'how' etc. For example, "who is playing with my toys?". Another form converts a statement into a question—for example, the sentence "I am angry" into the question "Am I angry?", or the sentence "I am playing with my toys" into the question "Am I playing with my toys?".

Embodiments herein achieve creation of interrogative sentences of the first type through the use of a new DW called the "interrogative DW". This is a special DW that indicates that the answer to a particular question is not known, and is to be queried from the interlocutor. This special DW, depending on which question it is the response to, takes on the interrogative word or construct that is created by that question; for example, if the question "when?" is answered by the Interrogative DW, the full sentence asks the question "when". An example is shown in FIG. 18, with the sentence "I give him the book" being modified to create questions.

Further, creation of interrogative sentences of the second type involves making use of a descriptor called the "interrogative descriptor". When this descriptor is tagged to a DW, it converts the output sentence from a sentence asserting the DW's meaning into a question interrogating the DW's meaning. In this way, the same technique described herein can be extended to questions also.

The sentence in FIG. 18, if modified with the interrogative descriptor, would have yielded the question "Did I give him the book?".

Construction of a Sentence's Meaning as a Graph of DWs, Questions and Descriptors In many embodiments, the target of any question may be, not just a simple DW, but a complex entity (which itself consists of DWs, questions and descriptors). Thus, the sentence is not just a linear structure of one DW and its question-answers and descriptors, but the question-answers themselves may have other question-answers, and so on. Some of these answers may be back-references, and the structure so formed has internal linkages, thus making the structure a networked structure or a hyper graph of the complex entity. The network structure or the hypergraph structure that is formed is the representation of the corresponding sentence.

Conversion into a Sentence

Embodiments herein further enable the process of converting a network structure representation of a sentence into a grammatically accurate sentence through repeated application of 'grammar rules' to the network. The process involves converting the network structure into a tree, and then to convert the tree into a list. This list, read out left to right, would yield the correct sentence in the chosen language.

A major body of work that is used in the transformation is the UNL (Universal Networking Language) structure. UNL is involves creating a pair of processes called Enconversion and Deconversion, which can be used to convert a data structure in the form of a network representing a sentence, into a grammatically correct sentence.

In a preferred embodiment, the network structure is converted unambiguously and automatically into a grammatically correct sentence through the use of reconverted and grammar rules appropriate to a particular language as specified by UNL.

Figure 19:
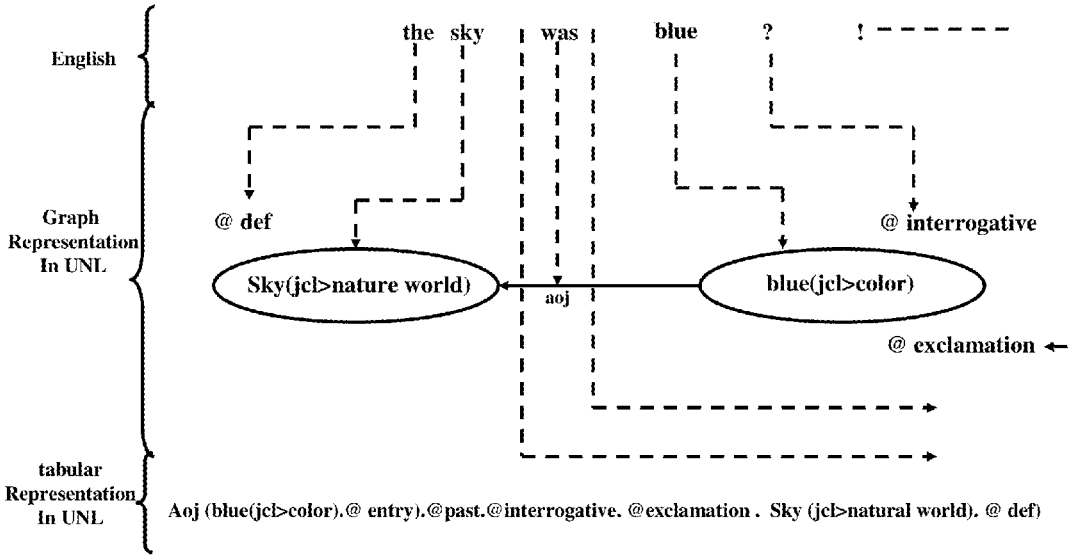
FIG. 19 depicts a UNL representation, according to embodiments as disclosed herein.

In the UNL approach, information conveyed by natural language is represented as a hypergraph composed of a set of directed binary labelled links (referred to as "relations") between nodes or hypernodes (the "Universal Words", or simply "UW"), which stand for concepts. UWs can also be annotated with "attributes" representing context information. As a matter of example, the English sentence 'The sky was blue?!' can be represented in UNL as in FIG. 19.

In the example above, "sky(icl>natural world)" and "blue (icl>color)", which represent individual concepts, are UWs; "aoj" (=attribute of an object) is a directed binary semantic relation linking the two UWs; and "@def", "@interrogative", "@past", "@exclamation" and "@entry" are attributes modifying UWs.

UWs are supposed to represent universal concepts and are expressed here in English words in order to be readable. They consist of "headword" (the UW root) and a "constraint list" (the UW suffix between parentheses), the latter being used to disambiguate the general concept conveyed by the former. The set of UWs is organized in an ontology-like structure (the so-called "UNL Ontology"), are defined in the UNL Knowledge Base (UNLKB), and are exemplified in the UNL Example Base (UNLEB).

Relations are expected to represent semantic links between concepts or sets of concepts in every existing language. They can be ontological (such as "icl" and "iof" referred to above), logical (such as "and" and "or") and thematic (such as "agt"=agent, "ins"=instrument, "tim"=time, "plc"=place, etc). There are currently 46 relations in the UNL Specs, and they define the syntax of UNL.

Attributes represent information that cannot be conveyed by UWs and relations. Normally, they represent information on tense (".@past", "@future", etc), reference ("@def", "@indef", etc), modality ("@can", "@must", etc), focus ("@topic", "@focus", etc), and other closed class categories.

The mapping between the question-answers and relations in UNL is shown in FIG. 20. The mapping between a representative sample of attributes and their corresponding descriptors is shown in FIG. 21.

In various embodiments, We claim the use of UW dictionary resources, UNL relations, UNL attributes, and UNL tools for AAC.

Picture Based Augmentative and Alternative Communication (AAC) System

The AAC system broadly comprises two portions. One is a mechanism of DW specification, where a user-interface is provided for a user to add descriptions and question-answers to a DW to make it a sentential representation. Another is a mechanism of ontology descent, where the user may specify a particular word (i.e. a DW) by traversing through ontology instead of specifying the word directly. These two techniques allow a powerful, intuitive mechanism to emerge; the power of the system is in its flexibility, since it can theoretically be extended to a very huge vocabulary of words; and the user-friendliness of the mechanism is in its reliance on two concepts both of which have been designed as a map of the human method of constructing language, viz. creating a sentence by building up elements through questions, and grouping words with similar meanings or categories into a hierarchical ontology.

Figure 22:
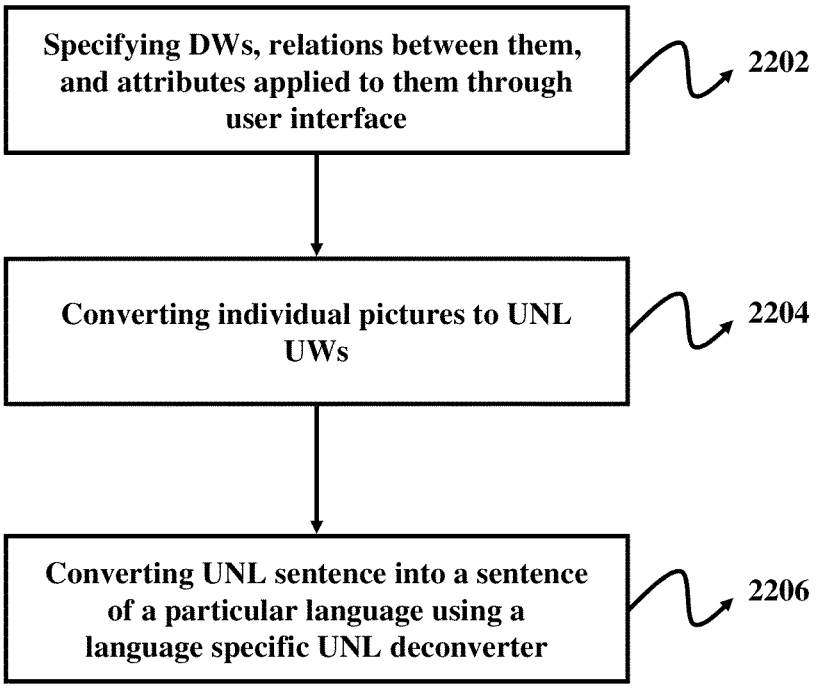
FIG. 22 depicts the mechanism used to create the desideratum, according to embodiments as disclosed herein.

The mechanism of the system, according to an embodiment, is shown in FIG. 22. The user interface is used to specify (2202) DWs, relations between them, and attributes applied to them, with individual pictures converted (2204) into UNL UWs. The UNL graph is then passed through (2208) a UNL deconverter for a specific language, in order to obtain the final sentence.

User Interfaces

Figure 23:
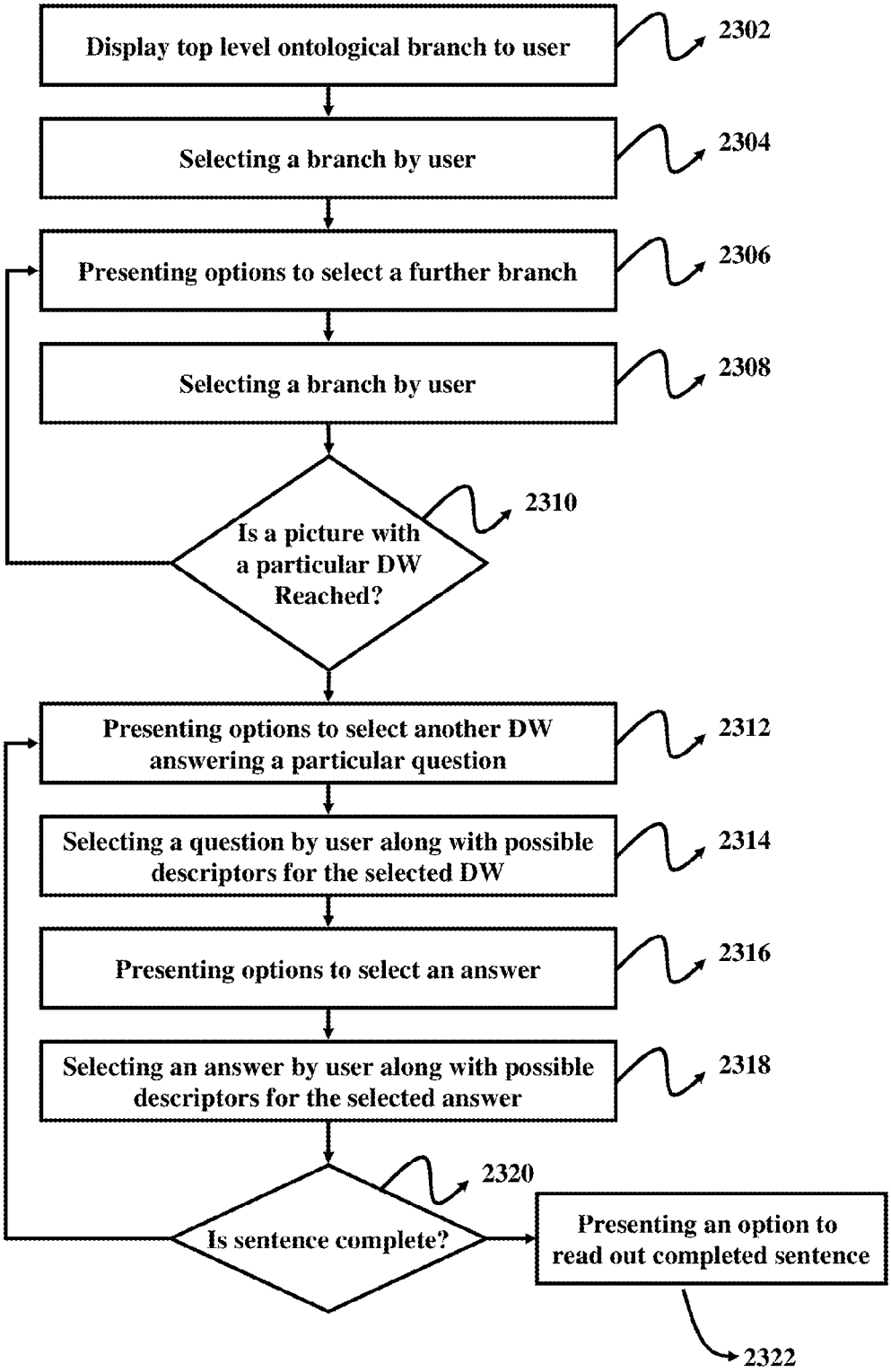
FIG. 23 depicts the process of graph creation, according to embodiments as disclosed herein.

The method of creating a sentence through a user interface is shown in FIG. 23, according to an embodiment. The system starts by displaying (2302) the top-level ontological branch to the user in the form of pictures. This branch may consist of top-level parts of speech, viz. nouns, verbs, adverbs and adjectives. Alternatively, this topmost branch may consist of user-defined contexts, such as 'school', 'home', 'festivals', 'body', 'hygiene', 'food', etc., which would correspond to a super-set or sub-set of the canonical hierarchy.

When the user selects (2304) a particular branch, the display 'descends' down the branch. It now shows children of the chosen branch. For example, under the category 'school', the user may have created branches for 'actions', 'places', 'people', 'things', and 'descriptives'. Alternatively, if the canonical ontology is used (or variants thereof), the category 'verbs' may have further sub-categories such as 'motion', 'body actions', 'possession', 'cognition', 'emotion' etc.

The user is then given (2306) the option to select a further branch. When this further branch is selected, the ontology is descended in a likewise manner. This process repeats (2308, 2310) until the user finally selects a particular DW (in other words, the picture corresponding to a particular DW).

Once a DW has been selected (2310), the user is given (2312) the option of selecting another DW which answers a particular question about the selected DW. This is done by displaying various questions on the screen, for the user to select what to ask. For example, if the DW verb 'eat' is selected, the questions shown on the screen may be 'eat what?', 'who eats?', 'eats with whom?', 'eats where?', 'eats how?', 'eats when?', etc.

If the DW noun 'father' is selected, the questions may either focus on describing 'father', or on identifying DWs for which the description is 'father'. For example, the former category would consist of questions such as 'whose father?', 'which father?', 'what kind of father?', 'how many fathers', etc. Questions of the latter category would consist of questions like 'what did father do?', 'what was done to father?', or 'what of father?'.

The user is given the option of selecting a question first. Once a question is selected (2314), the user is given (2316) the option of selecting the answer. The process of selecting the question and answer are both decided by methods described in the next section.

In various embodiments, in the interest of screen space, the answer may have to be selected (2318) by descending a hierarchy, similar to the descent described above. When the question and answer are both selected, this forms a particular edge of a graph joining two nodes. Now the user has two options. Either he can go on creating new entries connected to the first selected node, or he can go on to create entries connected to the second selected node.

Whenever a user has created an edge, this choice of where the next node is to be attached is made explicit, and the questions (and thereafter the answer to the question) is made based on statistical information about that node.

Figure 24:
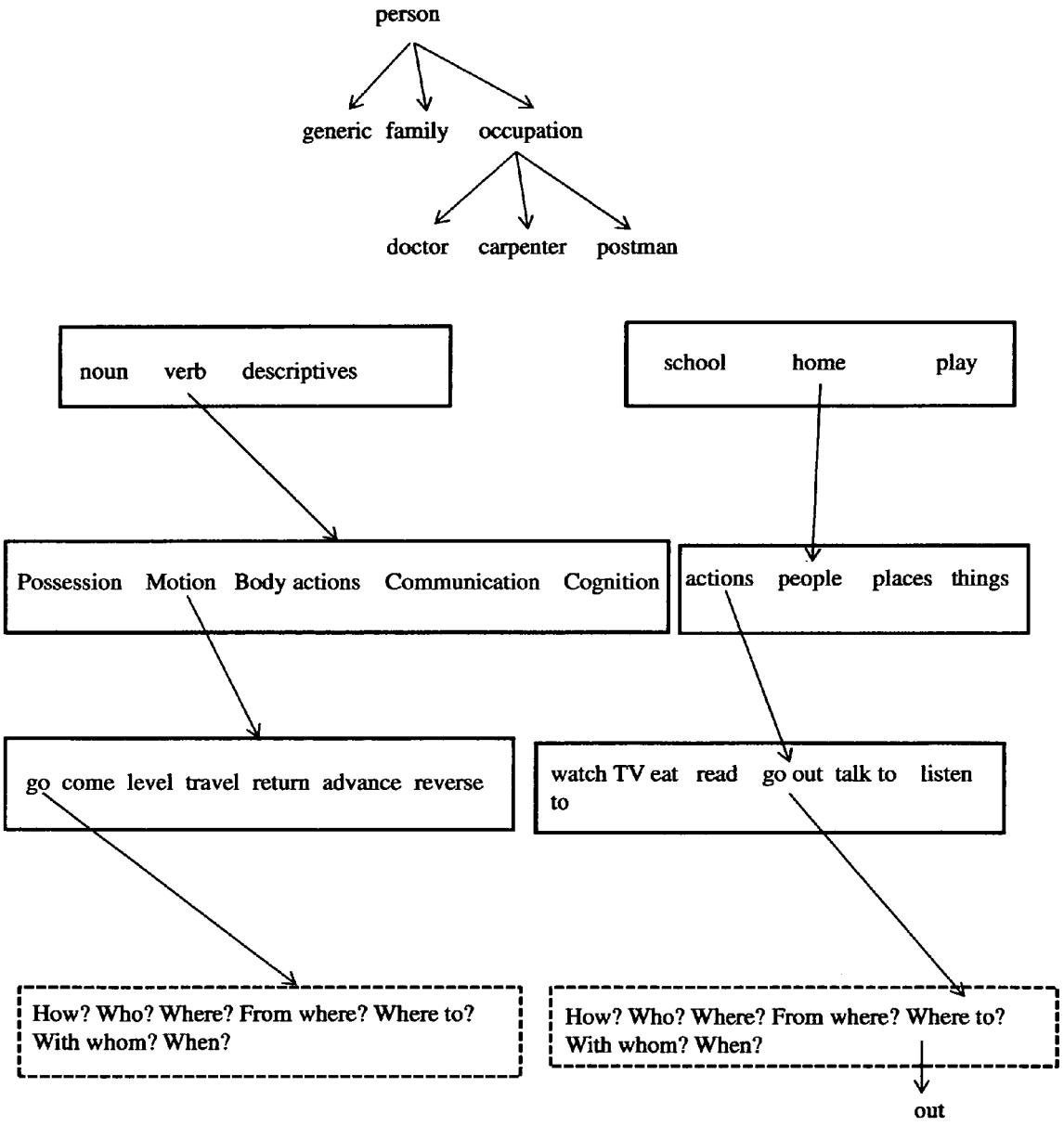
FIGS. 24, 25 and 26 depict the process of sentence conversion, according to embodiments as disclosed herein.

At any point, the user may also add (2314, 2318) descriptors to any node. This is done by selecting from a list of descriptors shown to the user corresponding to a particular node. In this manner, the entire graph is created. The process of graph creation in this fashion is illustrated in FIG. 24.

In various embodiments, the graph is converted into a natural language text by passing it through a deconversion algorithm. In some embodiments, this may be done after the entire graph is constructed. In some other embodiments, the deconversion may be done stage-wise, so as to show the user how the sentence is progressing.

The user is allowed to edit, delete or add to any part of the graph. This is done by selecting one of the nodes, and choosing an option of deleting a question-answer, or editing it.

Figure 25:
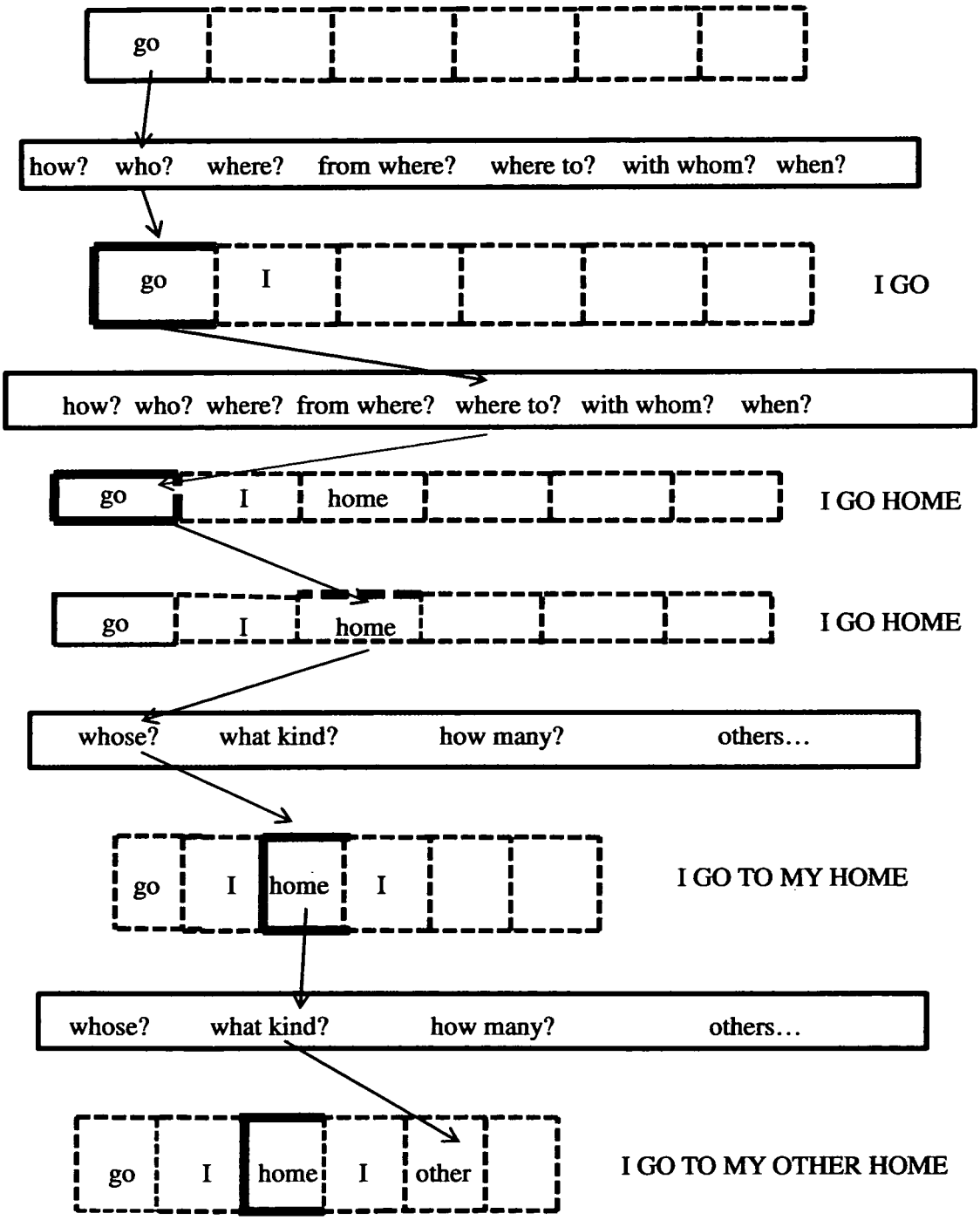
Figure 26:
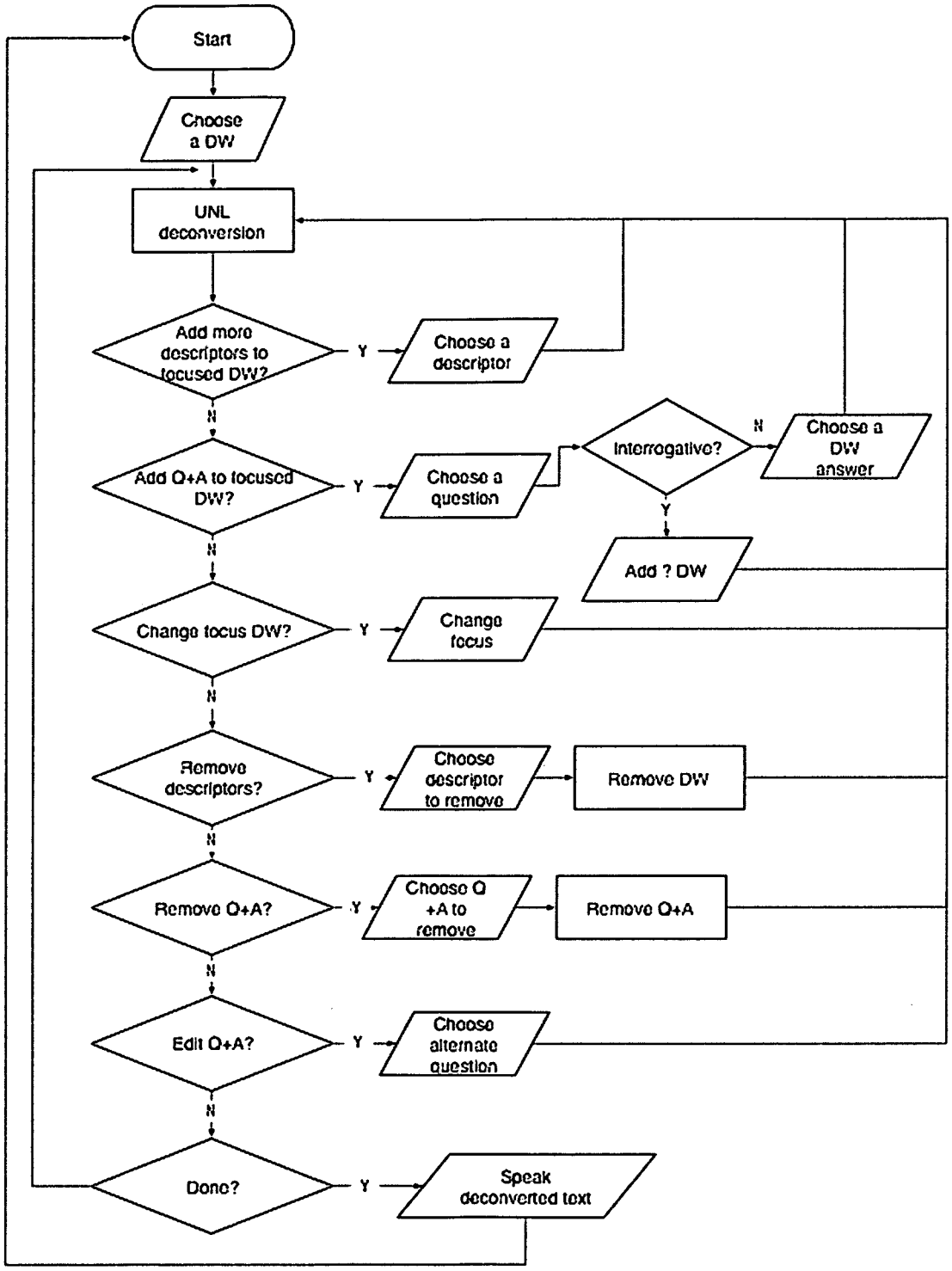

When the full sentence has been constructed to the satisfaction of the user, the user chooses a special option, which speaks out the sentence thus constructed. (FIG. 25 & FIG. 26)

The set of questions to ask may be chosen from a manually reviewed or compiled list of questions of each word in the DW. These set of questions may also flow down from a hierarchy through an appropriate ontology. This would be the most controllable way of creating questions accurately.

On the other hand, if the number of words is quite large, the set of questions for the word may be identified statistically, by trawling through a very substantial corpus of question-answers (such as a large collection of UNL documents). For each entry in the corpus, an entry is made in a statistical table, describing the source, the destination and the question. For example, if the following entry is found in a corpus:

Eat-who→father. This is reflected in a number of statistical tables. The verb 'eat' now has the entry [who?—father]. The noun 'father' now has the entry [does what?—eat].

After this exercise is fully performed on the entire corpus, the set of statistical rules may be stored (perhaps after pruning based on a cut-off frequency) and used for retrieval.

In order to account for specificities in the corpus, a process of 'blurring' may be performed by creating rules based on the ontology. For example, if it is found that a large number of entries are made in the statistical tables against ['visit'—whom?—] for words that all fall in the category 'person', the specific rules may be erased, and the general rule ['visit'—whom?—person] may be added instead.

This process of making rules may be further generalized by considering exceptions and specificities. The process of making rules may be made more accurate by using statistical techniques such as correlation.

Questions are chosen now by looking up which questions have maximum statistical representation for a particular DW entry. For example, if the word 'eat' has 1511 entries for 'who?', 1031 entries for 'what?', 411 entries for 'how?', 159 entries for 'with whom?', 13 entries for 'where?' and 8 entries for 'when?' in addition to a number of statistically insignificant questions, the statistically significant questions are shown on the screen, in descending order of frequency.

Also in this case, questions are chosen, not only by looking at a particular word's rules, but also by looking at the rules of its various parent categories. For example, to decide what questions must be asked of 'father', one would not only select questions in our statistical table that correspond to 'father', but also questions that correspond to 'family' (of which 'father' is a part), 'people' (of which 'family' is a part), and 'animate beings' (of which 'people' is a part).

In addition to these questions, as a matter of abundant caution in not restricting the choice of sentences that can be created, in various embodiments, the user may also be shown an 'other' option, which will allow the user to explicitly select a question and its answer out of the list of all possible questions and all possible answers.

Once a DW and a question are selected, a similar process of statistical lookup is used also to show statistically significant categories and choices to the user for selecting the answer.

Prediction may be performed by storing rules for each word, but more generally, it may be performed by creating rules for sets of words. Thus, prediction rules may apply to ontological categories instead of being applicable to specific words. An example is shown in FIG. 27.

The User Interface for a Sentence Creation Using Sentence Frame (or Template)

In another embodiment of the invention, the user is shown a different system of choosing a sentence. This is based on the concept of a 'sentence frame'.

A sentence frame combines the aspects of question statistics with the aspects of answer statistics, while using a deconverter to show the most appropriate sentence that would be created when a particular word is chosen.

For example, suppose the chosen word is "eat". Now the verb 'eat' is incomplete without an agent (the 'who?' of the action) and an object (the 'what?' of the answer). Therefore, it is likely that when a list of questions linked to 'eat' are formed, the questions 'who?' and 'what?' are statistically significant. The statistically most likely answers to these questions are likely to be derived from the categories 'people' and 'food items' respectively. Thus, a potential sentence frame for the word 'eat' would be: "Eat, who?: I, what?: food", which would be deconverted to the sentence "I eat food".

In addition to these statistically unique questions, a number of other questions are statistically significant but not statistically unique. For example, almost any verb may be modified with the questions 'when?' and 'where?', since the correlation between the answer to these questions, and the DW of which they are being asked, is slight. These elements may be added to the frame elliptically.

In this embodiment of the invention, therefore, when the word 'eat' is selected, the system would display the words and pictures for the sentence "I eat food", and allow the user to customize this sentence. The sentence would be shown on the screen with the component questions made explicit (e.g. the word 'I' would be placed under the category 'who?' in the above example), and a number of other categories would also be shown, but without any entries under them. (These categories may be added by the user if needed. The elliptical categories mentioned above would be candidates for these 'omitted' categories.)

Alternatively, 'omitted' categories can be shown in a different colour or format, to indicate that they are not 'officially' part of the sentence.

Each element offers four options to the user. One option is to change the element to another. The second option is to delete the element, in order to either remove it from the frame or to refer to it elliptically. The third option is to build a sentence frame around the element, thus 'nesting' it. The fourth option is to add descriptors to the DW.

It is probable that the sentence so predicted is the same sentence that the user wants to create. However, if the user wishes to utter a different sentence, he would have to customize the basic template. For instance, if the user wishes to say 'My friend eats bread' instead of 'I eat food', he would click on the word 'I', and choose the option representing 'friend'. He would click on the word 'food' and choose instead the option representing 'bread'. He would click again on the word friend, but now, instead of choosing a replacement word, he would choose the 'customize' option, and be shown a sentence frame for the word 'friend' instead. (This frame, for example, may be of the form 'my three best friends', illustrating the questions 'whose?', 'how many?' and 'what kind?'.)

Figure 28:
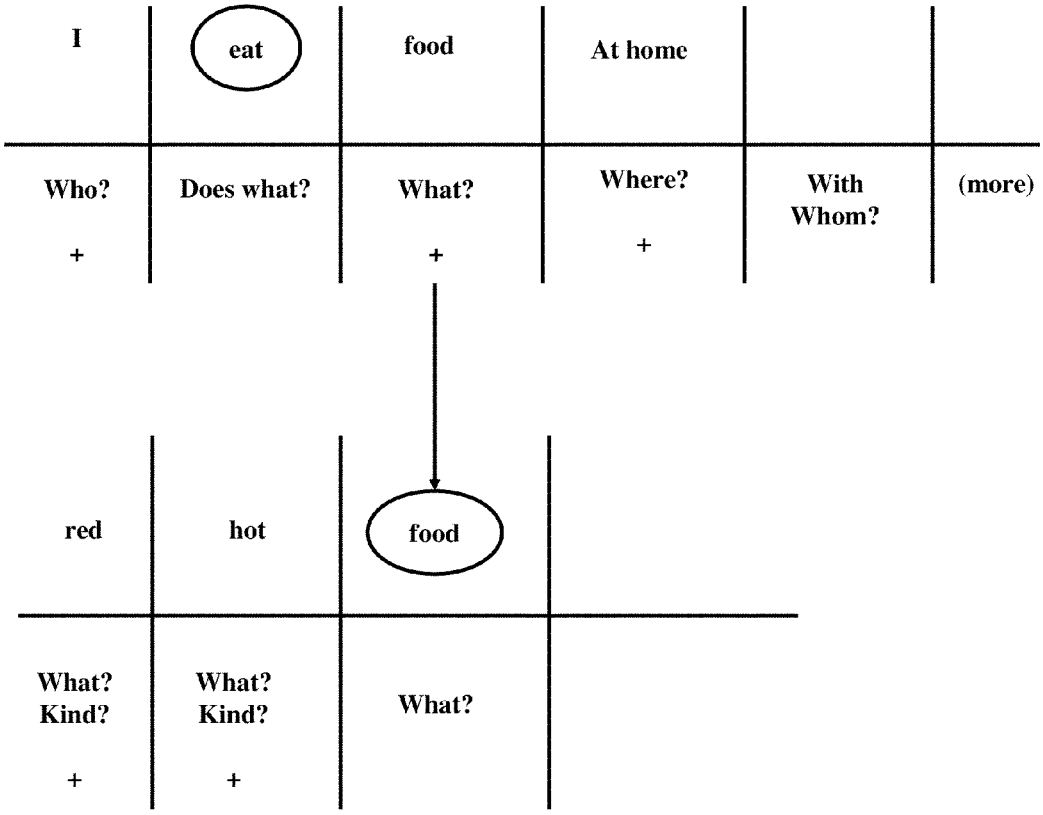
FIG. 28 depicts a user interface, according to embodiments as disclosed herein.

It must be emphasized that the internal representation of the sentence remains in the DW graph form, from which the natural language representation, as well as the picture representation, are both derived on a continuous basis. The user interface for this is shown in FIG. 28.

For the purpose of providing the user feedback about the eventual sentence that is being constructed, the device will have to represent the sentence in some form or fashion for display.

We describe two embodiments here. The first is a linear representation. In this representation, when the DW tree is de-converted into a sentence, the words corresponding to the DWs are tagged with a pointer to the DW. This pointer is stored in a manner that it can be removed without substantial effort when finally presenting the textual sentence; for example, the sentence may be created in the following fashion:

I[0001] want[1238163] my[0001] ice-cream[91518171], where the numbers within brackets are DW ids.

The pictures are then shown corresponding to the words that they represent. For example, the picture corresponding to the word 'I' is shown the word 'I' etc. In this manner, the user can theoretically map the entire sentence from the images alone.

A variant of this technique is to first create a list of DWs that are used in the sentence tree. This linear list is indexed, and these indices are tagged in the final textual sentence. For example:

I[1] want[2] my[0] ice-cream[3], where the numbers are indices into an array that contains the elements [my, I, want, ice-cream].

Another embodiment is, therefore, to show the sentence on screen in a tree format. This would include all the attributes (shown perhaps as small icons) and all the relations. The amount of detail may be adjusted depending on the screen size and screen resolution.

Figure 29:
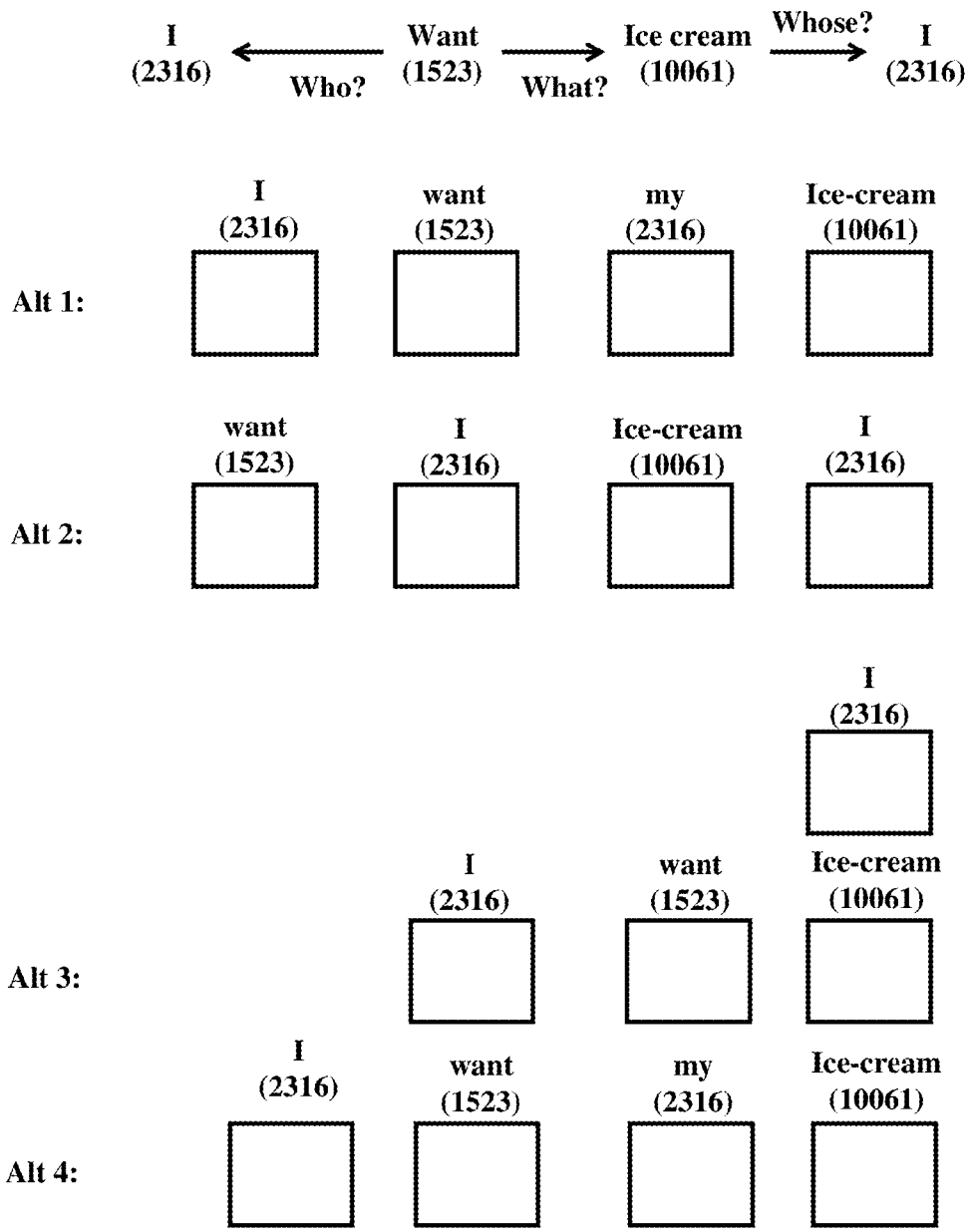
FIG. 29 depicts use of grouping elements, according to embodiments as disclosed herein.

A variant of this embodiment, where the tree structure is made explicit, is to use a grouping element (for example parentheses) to incorporate the tree structure right in the linear list display. These options are depicted in FIG. 29.

Conversion of a graph representing the sentence (DWs, relations and attributes) by the repeated application of language-specific grammar rules, and obtaining a grammatically correct sentence At the end of applying all of the techniques described in the preceding sections, the result is a graph of DWs, descriptors and questions-answers. The final step of the problem is to convert this graph into an actual sentence string.

The process of conversion of the graph into a sentence requires the repeated application of grammar rules. This is done in the following way:

- In the graph of DWs, all question-answers are converted into their corresponding UNL relations. For example, the question 'who?' would be converted into the UNL relation 'agt'.
- For each DW, the list of descriptors are converted into a list of UNL attributes.
- For each DW, a Universal Word (UW) that corresponds to the DW is found. One way of doing this is to use the WordNet ID associated with the DW to look up a corresponding UW.
- The entire graph of DWs is rewritten in the form of a UNL graph or a list of UNL relations, UWs and attributes.
- The UNL graph thus obtained is converted into a natural language by passing it through a UNL deconverter.

The Use of Contexts to Limit the Number of Pictures Shown on Screen

The system of ontology descent described above has the advantage of being able to support a very large vocabulary. By the same token, however, it also has the disadvantage that the system may prove difficult to use for young children, people with cognitive difficulties, or people who are unfamiliar with a language. Also, in any specific context (such as at home, at work or at play), the frequencies of using various words dramatically varies, and time is wasted in scanning through a list of words of which many are irrelevant in the current context.

Embodiments herein achieve a mechanism of limiting the vocabulary displayed on the screen through the use of a system of tags, called contexts. Each DW in the dictionary can be tagged with one or more contexts. These contexts work by grouping together words that have a higher frequency of usage in a particular context. For example, the words 'teacher', 'blackboard' and 'exam' may not be found very readily outside of a school environment. These words are assigned the tag 'school'. The tag is non-exclusive, so the word 'teacher' may also have a number of other tags. There are also tags that are applied depending on the perceived difficulty of the word; for example, some words may be tagged 'easy', others 'difficult', and others 'very difficult'. There may be tags based on classroom learning of vocabulary; for example, tags such as 'grade1', 'grade2' and so on. There may also be a tag called 'all words' which, when encompasses all words in the dictionary. A special tag, 'all contexts', is used to tag words whose frequency is high regardless of context (for example, the pronouns 'I', 'you' etc.) Tags are referred to in the present invention as 'contexts'.

In order to restrict words being chosen, the user selects one or more contexts, and the dictionaries and ontology contract to represent only the words that are attributed to the contexts chosen. The context 'all contexts' is chosen by default, in order to show the most commonly used words in all contexts.

All contexts are customizable and extensible, with users being allowed to create new contexts or edit the tags on existing words. Contexts may be switched in and out at any point in time, including in the middle of a word selection. This allows the user flexibility with regard to selecting as broad or as narrow a dictionary as they please.

Storage of Templates (Sentence Frames) and Statistics on a Remote Server

Sentence frames constitute a significant chunk of memory for the system. If one assumes the vocabulary of a system to be about 5000 words, each word may have 3-5 questions, and each question may have 3-5 answers.

This complexity can be decreased (to some extent) using the concept of template trees described above. However, the use of template trees only serves to 'blur' the information represented for each word. It is preferable to use both template trees, as well as per-word templates.

Estimation would, therefore, yield about 100,000 entries in the template tree. These entries may take up significant space, and may also not all be available (instead, they may be iteratively created or inferred as more and more users use the system).

Therefore, in various embodiments, the database of frames can be created, maintained and served from a remote server, as opposed to hosting on a user device.

Therefore, when the statistical tables and algorithms are not locally present, but accessed instead over a network (i.e. over the 'cloud'), it is possible to store a large number of statistical tables, and provide highly scalable processing and storage capabilities, which are made available to a large number of 'clients', which are at the customer's premises.

Storage of Grammar and Dictionary Data on a Remote Server Accessed Through the Internet According to various embodiments herein, a sentence may be described as a graph of DWs (represented in its abstract as numbers), associated with a list of descriptors, and joined together by questions. In many instances, this entire data structure can be represented in a few kilobytes of information even for rather complex sentences.

In various embodiments, the data structure could be created in the user's device, but the actual translation into a language could be performed at a remote server, by sending the DW over to the remote site. This allows for substantial sophistication in the deconversion algorithm, and also allows the system to scale to support a very large number of languages even with a single client.

Automation of the Process of Tagging DWs with Images

In various embodiments, a service such as ImageNet may be used in order to automatically query, and return, images relevant to any particular DW, by sourcing it from links to images present all over the internet.

Example Embodiment of a User Device

Figure 30:
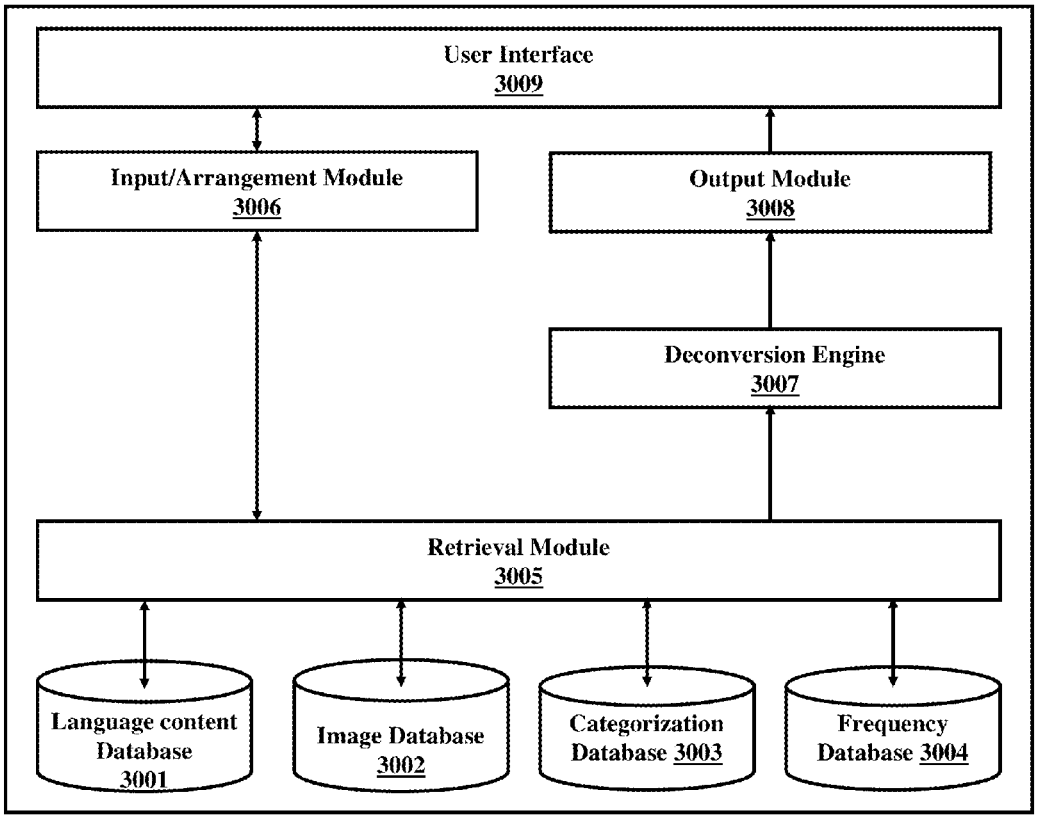
FIG. 30 is a block diagram illustrating an example implementation of a user device, according to embodiments herein.

FIG. 30 shows an example implement of a user device, according to embodiments herein. The device comprises a language content module 3001, image database 3002, categorization database 3003, frequency database 3004, retrieval module 3005, input/arrangement module 3006, deconversion module 3007, output module 3008 and a user interface 3009 comprising a plurality of interfaces. The language content module 3001 may further comprise one or more dictionaries. Further, each dictionary may comprise multiple entries which may be in the form of disambiguated words, associated natural language words, annotations and so on. Further, the image database 3002 comprises images associated with each of the disambiguated word present in the language content module. In an embodiment, one or more images may be associated with each disambiguated word. Further, the categorization database 3003 organizes dictionaries in the form of one or more hierarchies. Further, the frequency database 3004 associates usage frequencies of different words, images and categories. In one embodiment, usage frequency may refer to number of times each word is used in a particular time period. Further, the retrieval module 3005 allows a user to retrieve disambiguated words. In an embodiment, the retrieval module 3005 may use a categorization system in order to retrieve the disambiguated words. The input/arrangement module 3006 allows the user to compose multiple disambiguated words into a graph or hypergraph structure. In the graph or hypergraph structure, the disambiguated words may be joined by question/answer relationships with multiple attributes attached to each word. Further, the deconversion engine 3007 converts the graph or hypergraph of disambiguated words into a natural language sentence. In an embodiment, the deconversion engine 3007 may use specific rules to convert the graph or hypergraph of disambiguated words into a natural language sentence. The output module 3008 prepares the output to be presented to the user via the user interface 3009. The user interface 3009 ultimately presents the final sentence to the user. The user interface may be a display, a voice based system, through email/message and/or a combination of these.

The embodiments disclosed herein can be implemented through at least one software program running on at least one hardware device and performing network management functions to control the network elements. The network elements according to various embodiments include blocks which can be at least one of a hardware device, or a combination of hardware device(s) and software module(s).

It is understood that the scope of the protection is extended to such a program and in addition to a computer readable means having a message therein, such computer readable storage means contain program code means for implementation of one or more steps of the method, when the program runs on a server or mobile device or any suitable programmable device. The method is implemented in a preferred embodiment through or together with a software program written in e.g. Very high speed integrated circuit Hardware Description Language (VHDL) another programming language, or implemented by one or more VHDL or several software modules being executed on at least one hardware device. The hardware device can be any kind of device which can be programmed including e.g. any kind of computer like a server or a personal computer, or the like, or any combination thereof, e.g. one processor and two FPGAs. The device may also include means which could be e.g. hardware means like e.g. an ASIC, or a combination of hardware and software means, e.g. an ASIC and an FPGA, or at least one microprocessor and at least one memory with software modules located therein The method embodiments described herein could be implemented in pure hardware, or partly in hardware and partly in software. Alternatively, the invention may be implemented on different hardware devices, e.g. using a plurality of CPUs.

The foregoing description of the specific embodiments will so fully reveal the general nature of the embodiments herein that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the embodiments herein have been described in terms of preferred embodiments, those skilled in the art will recognize that the embodiments herein can be practiced with modification within the spirit and scope of the claims as described herein.

I claim:

1. A method of picture based communication by a user, said method comprising:

obtaining input from said user using a processor through a sequence of picture selections on a user device by an input/arrangement module;

representing meaning of said input through a spatial configuration of words by a retrieval module and a deconversion module;

transforming said spatial configuration of words into a sentence of particular language by an output module; and communicating said sentence of particular language to a party receiving said communication, through a user interface module, wherein said language is based on an input representing mode of communication received from said user.

2. The method as in claim 1, wherein said mode of communication is at least one among:

audio;

visual; and audio visual.

3. The method as in claim 1, wherein said representation of said meaning through said spatial configuration is language independent.

4. The method as in claim 1, wherein transforming said spatial configuration of words happens on said user device.

5. The method as in claim 1, wherein transforming said spatial configuration of words happens on a remote server.

6. The method as in claim 1, wherein obtaining user input using a processor for picture based communication by said input/arrangement module comprises:

presenting a user with series of choices based on at least one hierarchy of categories, wherein said hierarchy is set by a categorization module;

identifying a first DW based on selections made by said user by said deconversion module;

presenting user with series of choices to further choose a series of cascaded set of questions and answers by said output module; and obtaining user selections to build said spatial configuration of words through said user interface module.

7. The method as in claim 6, wherein obtaining user input comprises obtaining descriptor information for identified DWs.

8. The method as in claim 6, wherein presenting choices to identify said first DW is based on categories obtained according to usage statistics of said categories.

9. The method as in claim 6, wherein presenting choices to choose a series of cascaded set of questions and answers is based on categories obtained according to usage statistics of questions.

10. The method as in claim 6, wherein presenting choices to choose a series of cascaded set of questions and answers is based on categories obtained according to usage statistics of answers.

11. The method as in claim 6, wherein presenting choices comprises limiting the number of choices based on context selected by the user.

12. The method as in claim 11, wherein context associated with a word is based on usage statistics of words occurring together within the same context.

13. The method as in claim 1, wherein said spatial configuration is a hypergraph.

14. The method as in claim 13, wherein said spatial representation of words is a DW hypergraph.

15. The method as in claim 6, said method comprising:

presenting intermediate representation of the meaning being conveyed by the user;

when user is not satisfied with said intermediate representation, user providing feedback through said device to make corrections in said intermediate representation.

16. The method as in claim 6, wherein said spatial configuration represents an interrogative sentence wherein the answer from said cascaded set of questions and answers is an interrogative marker.

17. The method as in claim 16, wherein said descriptor is an interrogative descriptor.

18. The method as in claim 14, wherein said DW hypergraph is a hypergraph of nodes and edges, wherein a node is represented by a combination of a DW and a plurality of descriptors or another hypergraph, and an edge is a represented by a set of question and answer.

19. The method as in claim 14, wherein transforming said DW hypergraph comprises:

mapping elements of said DW hypergraph to corresponding elements of a semantic network language;

converting said DW hypergraph into a hypergraph in the syntax of the semantic network language;

converting said semantic network language hypergraph into a semantic network language sentence using a converter; and converting said semantic network sentence into a sentence of a particular language using a language specific converter.

20. The method as in claim 14, wherein the semantic network language is Unified Network Language (UNL).

21. The method as in claim 14, wherein transforming said DW hypergraph comprises:

converting said DW hypergraph into a DW sentence using a converter; and converting said DW sentence into a sentence of a particular language using a language specific deconverter.

22. The method as in claim 21, wherein transforming said spatial configuration of words comprises:

converting said DWs into UNL Universal Words using a DW to Universal Word dictionary;

converting said Question-answer relationships into UNL relations;

converting said descriptors into UNL attributes;

converting the UNL hypergraph into a sentence of a particular language using a UNL deconverter for that language.

23. The method as in claim 14, wherein representing meaning of said user input through said DW hypergraph comprises:

associating a selected picture to a DW ID obtained from a DW dictionary.

24. The method as in claim 23, wherein said DW ID is a unique identifier obtained from an external lexical database.

25. The method as in claim 23, wherein a picture in said DW dictionary is automatically sourced from external database.

26. The method as in claim 23, wherein said DW dictionary is selected from multiple DW dictionaries based on user profile information.

27. The method as in claim 26, wherein said user profile information comprises:

age;

disability;

cognition level of user;

literacy level of the user;

cultural background of the user; and educational profile of the user.

28. A system of picture based communication by at least a user, said system comprising:

at least an input/arrangement module for obtaining at least an input from said user using a processor through a sequence of picture selections on a user device;

at least a retrieval module and a deconversion module for representing meaning of said input through at least a spatial configuration of words;

at least an output module for transforming said spatial configuration of words into at least a sentence of particular language; and at least a user interface module for communicating said sentence of particular language to a party receiving said communication, wherein said language is based on an input representing mode of communication received from said user.

29. The system as in claim 28, wherein said spatial configuration is a DW hypergraph.

30. The system as in claim 29, wherein transforming said DW hypergraph comprises:

means for mapping elements of said DW hypergraph to corresponding UNL elements;

means for converting said DW hypergraph into a UNL hypergraph;

means for converting said UNL hypergraph into a sentence of a particular language using a language specific deconverter.

31. The system as in claim 29, wherein transforming said DW hypergraph comprises:

means for converting said DW hypergraph into a DW sentence using a converter; and means for converting said DW sentence into a sentence of a particular language using a language specific deconverter.

32. The system as in claim 28, wherein said spatial representation of words is a UNL hypergraph of UWs.

33. The system as in claim 32, wherein transforming said spatial configuration of words comprises:

means for converting said UNL hypergraph into a sentence of a particular language using a language specific deconverter.

34. A system for picture based communication by a user, said system comprising:

a user interface module for obtaining at least a user input using a processor in the form of picture selections, wherein said user is presented with a plurality of choices to identify relevant disambiguated words (DWs), associated cascaded set of questions and answers and descriptors for identified DWs;

a retrieval module for retrieving DWs and for providing said user input information for constructing a sentence;

an arrangement module to construct a hypergraph of DWs using said user input;

a deconversion module to convert a hypergraph of DWs into a natural language sentence;

an input module for receiving input from a plurality of user interface devices; and an output module for providing output to said plurality of user interface devices.

* * * * *